US008844626B1

(12) United States Patent
Krug

(10) Patent No.: US 8,844,626 B1
(45) Date of Patent: Sep. 30, 2014

(54) METHOD AND APPARATUS FOR AUTONOMOUS OIL AND GAS WELL DOWN-HOLE PUMP LEAKAGE TESTING

(75) Inventor: David A. Krug, Cedar Hills, UT (US)

(73) Assignee: Rodmax Oil & Gas, Inc., Lindon, UT (US)

( * ) Notice: Subject to any disclaimer, the term of this patent is extended or adjusted under 35 U.S.C. 154(b) by 638 days.

(21) Appl. No.: 13/200,444

(22) Filed: Sep. 22, 2011

Related U.S. Application Data

(60) Provisional application No. 61/404,128, filed on Sep. 28, 2010.

(51) Int. Cl.
*E21B 47/10* (2012.01)

(52) U.S. Cl.
USPC ..... 166/250.08; 73/40; 702/51

(58) Field of Classification Search
USPC ..... 166/250.01, 250.08, 335, 336, 337; 73/40; 702/47, 51, 1, 127, 187, 189
See application file for complete search history.

(56) References Cited

U.S. PATENT DOCUMENTS

| | | | | |
|---|---|---|---|---|
| 1,877,467 | A | 9/1932 | Lake | |
| 1,889,730 | A | 11/1932 | Lake | |
| 2,540,049 | A * | 1/1951 | Hinson | 250/260 |
| 2,673,613 | A | 3/1954 | Irwin | |
| 2,741,915 | A | 4/1956 | Renken et al. | |
| 2,964,941 | A * | 12/1960 | Chamberlain et al. | 73/152.61 |
| 3,152,474 | A | 10/1964 | Jay | |
| 3,527,094 | A | 9/1970 | Yew et al. | |
| 3,838,597 | A | 10/1974 | Montgomery et al. | |
| 3,851,995 | A | 12/1974 | Mills | |
| 3,951,209 | A | 4/1976 | Gibbs | |
| 3,972,648 | A | 8/1976 | Sangster | |
| 3,998,568 | A | 12/1976 | Hynd | |
| 4,015,469 | A | 4/1977 | Womack et al. | |
| 4,043,191 | A | 8/1977 | Mills | |
| 4,064,763 | A | 12/1977 | Srinivasan | |
| 4,125,163 | A | 11/1978 | Fitzpatrick | |
| 4,512,149 | A | 4/1985 | Weaver | |
| 4,873,635 | A | 10/1989 | Mills | |
| 4,947,936 | A | 8/1990 | Ellwood | |
| 5,044,888 | A | 9/1991 | Hester, II | |
| 5,182,946 | A | 2/1993 | Boughner et al. | |
| 5,252,031 | A | 10/1993 | Gibbs | |
| 5,458,466 | A | 10/1995 | Mills | |
| 5,464,058 | A | 11/1995 | McCoy et al. | |
| 5,481,873 | A | 1/1996 | Saruwatari et al. | |
| 5,823,262 | A | 10/1998 | Dutton | |
| 5,829,530 | A | 11/1998 | Nolen | |
| 7,168,924 | B2 | 1/2007 | Beck et al. | |
| 7,212,923 | B2 | 5/2007 | Gibbs et al. | |
| 7,373,971 | B2 | 5/2008 | Montgomery | |
| 7,437,215 | B2 | 10/2008 | Anderson et al. | |

(Continued)

*Primary Examiner* — Daniel P Stephenson
(74) *Attorney, Agent, or Firm* — J. David Nelson

(57) ABSTRACT

A method for autonomous testing of traveling valve assembly leakage and standing valve leakage for an oil or gas rod pumped well installation, and for autonomous adjustment of one or more pump operation characteristics based upon the autonomous test results. Traveling valve assembly leakage testing includes autonomous stopping and holding of the polished rod during an upstroke, autonomous determination of a rate of change in the polished rod load, and autonomous determination of a traveling valve leakage factor. Standing valve leakage testing includes autonomous stopping and holding of the polished rod stationary during a down stroke after weight transfer, autonomous determination of a rate of change in the polished rod load, and autonomous determination of a standing valve leakage factor.

52 Claims, 28 Drawing Sheets

(56) References Cited

U.S. PATENT DOCUMENTS

| | | | | |
|---|---|---|---|---|
| 7,878,250 | B2 | 2/2011 | Sheldon | |
| 2004/0139149 | A1 | 7/2004 | De Sousa et al. | |
| 2005/0283277 | A1 | 12/2005 | Schulz | |
| 2006/0149476 | A1 | 7/2006 | Gibbs et al. | |
| 2007/0020110 | A1 | 1/2007 | Mills | |
| 2007/0286750 | A1 | 12/2007 | Beck et al. | |
| 2008/0010020 | A1 | 1/2008 | Ellender et al. | |
| 2008/0314581 | A1 | 12/2008 | Brown | |
| 2009/0024442 | A1 | 1/2009 | Brink et al. | |
| 2009/0024443 | A1 | 1/2009 | Graham et al. | |
| 2009/0055029 | A1 | 2/2009 | Roberson et al. | |
| 2009/0125367 | A1 | 5/2009 | Brink et al. | |
| 2009/0276100 | A1 | 11/2009 | Malki et al. | |
| 2011/0240937 | A1 | 10/2011 | McEwan et al. | |
| 2013/0024138 | A1* | 1/2013 | Mills | 702/47 |
| 2014/0205466 | A1* | 7/2014 | Best | 417/46 |

* cited by examiner

METHOD AND APPARATUS FOR AUTONOMOUS OIL AND GAS WELL DOWN-HOLE PUMP LEAKAGE TESTING

RELATED APPLICATION

This application claims priority of and is a continuation of a prior filed U.S. provisional application, Application No., 61/404,128, filed on Sep. 28, 2010.

BACKGROUND OF THE INVENTION

Rod pumping an oil or gas well by a positive displacement fluid pump which consists of a traveling valve, a working barrel and a standing valve among other parts is well known art within the oil and gas industry. Rod pumping is centuries old, traced back to the Roman Empire which utilized the pressurizing ability to draw and lift fluids, typically water, great distances vertically. Similar rod pumping installations were used to de-water underground mine shafts hundreds of feet deep during the $16^{th}$ century. The following terms/definitions for common oil and gas industry terms, shall apply to this application.

OPERATING COMPANY: The owner of the right to drill or produce a well, or the entity contractually charged with drilling a test well and production of all subsequent wells which produce sellable petroleum products.

MAIN OBJECTIVE for OPERATING COMPANIES: is to produce as much sellable hydrocarbon product(s) with the lowest daily operating expense including human labor. Along with minimizing the annualized costs of lost production caused by well system failures in addition to the costs associated with repairing all well failures.

HYDROCARBON: A naturally occurring organic compound comprising hydrogen and carbon. Hydrocarbons can be as simple as methane [$CH_4$], but many are highly complex molecules, and can occur as gases, liquids or solids. The most common hydrocarbons are natural gas, oil and coal.

ADSORPTION: The property of some solids and gases to attract and collect on their surfaces. Coal seams and methane gas are typically found together. Methane adsorbs to the surface of coal while under pressure caused from ground water acting on the coal seam or coal bed.

DELIQUIFICATION: Also referred to as "gas well dewatering", is the general term for technologies used to remove water or liquids or condensates build-up from producing gas wells all of which hinder natural gas production.

PETROLEUM: is a complex mixture of naturally occurring hydrocarbon compounds found in rock. Petroleum can range from solid to gas, but the term is generally used to refer to liquid crude oil.

FIELD: An accumulation, pool, or group of pools of hydrocarbons in the subsurface or subterranean. A hydrocarbon field consists of a reservoir in a shape or formation that has trapped hydrocarbons and that is covered by an impermeable, sealing rock. Typically, industry professionals use the term with an implied assumption of economic size. Reservoir formation is a commonly used term to describe the type of ground in which the trapped pools of hydrocarbons are found and produced from.

PRODUCTION: The phase that occurs after successful exploration and development and during which hydrocarbons are removed from an oil or gas field and produced at the surface of the well for additional processing and resale. Producing an oil or gas well by artificial means is lifting the subterranean fluids which enter the bottom of the well bore to the surface. The lifting energy is called artificial lift. Producing a well is also called pumping a well, it is synonymous.

ARTIFICIAL LIFT: Any system that adds energy to the fluid column in a wellbore with the objective of initiating and improving production from the well. Artificial-lift systems use a range of operating principles, including rod pumping, electric submersible pumps (esp), progressive cavity pumps (pcp), gas lift, plunger lift, jet pumps (hydraulic lift) and several other lesser used techniques.

ROD PUMPING: Is the most common artificial-lift system used in land-based operations today. Over 70% of all oil wells are currently produced using this technique. The down-hole positive displacement pump is operated and controlled thru lifting and lowering the rod string via the surface unit during operation. Rod pumping is the only form of artificial lift capable of pumping a well virtually dry and not damage itself if operated correctly.

WELL BORE DATA: Is commonly used to describe the entire well installation. It is also called the well bore diagram. It includes all information related to the complete installation of the well in the ground. It includes casing and production tubing string information such as sizes, weights, and grades plus rod string information including quantities of, lengths of, sizes and quantities of each size and length as well as all coupling information along with grades of material types. The well data also covers pump setting depth, length, how straight or not straight the well was initially drilled, is the well deviated, is the well a directional along with all down-hole pump specifics such as API type, bore, stroke, pump clearance, materials of construction, types of valves, quantities of valves.

SURFACE UNITS: Are known by several different names such as; surface unit, nodding donkey head, pump jack, Lufkin plus others. The surface unit lifts and lowers the polished rod. Mechanically driven units use a counterbalance that reduces the high torque requirements during the lifting cycle. The counterbalance averages the peak torque requirements of the complete pump cycle to allow for a smaller prime mover. Mechanically counterbalanced surface units have tremendous amounts of moving inertia, rendering them very difficult to stop and hold a given position upon command, hence it is not feasible for them to stop and dwell at the top of the polished rod lifting cycle. Since they are by nature all mechanical it is impossible for them to vary their polished rod travel distances autonomously. They must use a means of mechanical or friction braking system applied via external force to stop and hold the polished rod stationary. The external control force to apply the brake is very commonly a human actuating a lever which in turn amplifies the human input force acting to set the braking device. Releasing the brake would be just the opposite. Some hydraulically powered surface units use high pressure nitrogen gas to act as the counterbalancing effect. Their counterbalance effect is temperature sensitive and changes based upon ambient temperature change. Their ability to stop and hold polished rod position is also severely compromised due to the manner in which the high pressure nitrogen gas is utilized to counterbalance the well.

POLISHED ROD: The polished rod fully supports the entire sucker rod string weight plus all fluid column loads plus part of the down-hole pump during lifting portion of the pumping cycle. The polished rod also seals the top of the wellhead preventing hydrocarbons from escaping.

SUCKER RODS: Very strong, solid rods that are mechanically threaded and torqued together to form a single unit, commonly called the rod string. The assembled rod string is completely supported by and below the polished rod. The rod string connects the surface unit to the pump at the bottom of the well installation.

ROD STRING: Also called sucker rod string, consists of the polished rod plus sucker rods and couplings threaded and torqued together completely supported by and below the polished rod. The rod string supports the fluid column weight for one half of the total pump stroke cycle as the surface unit lifts the rod string. The rod string is one entire elastic unit. It stretches and contracts based on forces applied to it along with load hanging below the polished rod. The rod string transfers surface energy to the down-hole pump for powering and controlling the pumping action including the rate of discharge for the down-hole pump. The rod string mechanically lifts the traveling valve of the down-hole pump.

PRODUCTION TUBING STRING: Also called the tubing string and the conduit from which subterranean fluids are artificially lifted to the surface. The tubing string is made up of sections of tube and couplings which are threaded and torque together. The tubing string supports the fluid column weight for one half of the total pump cycle during rod lowering after weight transfer has occurred. The rod string reciprocates within the inside area of the tubing string. The standing valve is attached to the tubing string.

FLUID COLUMN: Is the fluid volume being lifted and lowered during the pumping cycle within the tubing string via the rod string. The fluid column dimensions are determined by the distance to the down-hole pump traveling valve multiplied by the inside diameter (area) of the tubing string minus all displaced volume from the rod string. The fluid column is supported and sealed by the traveling valve during lifting portion of pump cycle.

DOWN-HOLE PUMP: Is a single acting positive displacement pump located within the bottom of the total well installation. The three main pump sub-assemblies are the traveling valve, standing valve and working barrel. They all interact during the pump motion cycle. Pump displacement is the volume of media drawn in and pushed out during one pump stroke. Pump diameter along with total distance lifted and lowered of the traveling valve affects pump displacement per pump cycle. Number of reciprocations per time period affects pumping rate.

ANNULUS: Is the differential area or volume difference between the inside diameter of the well casing and the outside diameter of the production tubing string. This volume is where fluid level is measured in height above the pump inlet. This volume is where the down-hole pump draws from during the intake portion of the pump cycle. This volume at the bottom of the installation is where reservoir liquids and gases enter through perforations within the casing. This volume is where natural gas is produced via the well head at the top of the well installation.

PUMP MOTION CYCLE: Is the complete lifting and lowering motion which powers and controls the down-hole pump, also called pump cycle. Lifting the traveling valve creates a void which allows well annulus fluids to be forced past the standing valve. Lowering the traveling valve initially begins the compression phase which forces the standing valve closed, pressurizing the trapped fluids and gases within the working barrel. Once internal pump pressure surpasses fluid column load the traveling valve is forced open. As the open traveling valve continues to be lowered the same trapped fluids and gasses are forced past the now open traveling valve added to the bottom of the fluid column for lifting toward the surface on future pump cycles.

PPRL: Peak Polished Rod Load equals the maximum force required to lift the entire rod string weight plus fluid column weight plus acceleration forces plus all friction forces encountered during the process of lifting the rod string at a given speed and acceleration. PPRL is measured at the polished rod and equals the force required of the surface unit to power and control the down-hole pump at a given pumping rate.

SPM: Strokes per Minute of the polished rod equals the total number of complete rod string lifting and lowering cycles per minute used to power and control the rod pump while producing the well at a given rate. As the SPM changes so does the pumping rate potential of the well. One stroke per minute is equivalent to one complete pump cycle.

POLISHED ROD TRAVEL: Is the distance that the surface unit lifts and lowers the polished rod. This is also the total distance that the rod string at the surface is lifted and lowered. The down-hole pump total travel is completely different, due to the elasticity of the complete rod string and total weights supported by the rod string. As the polished rod travel distance changes so does the pump displacement; one long stroke has larger pump displacement than one short stoke.

DOWN-HOLE PUMP TRAVEL: Is a value affected by many different forces during the course of rod pumping an oil or gas well. The rod string plus tubing string both stretch; the total pump travel is typically less than the polished rod travel, hence under travel. However, depending upon the operating characteristics, total loads, the elasticity of material construction plus pumping SPM the down-hole pump could also experience over travel, meaning the down-hole pump may travel linearly further than the polished rod.

WEIGHT TRANSFER POSITION (WTP): Is the position where the traveling valve ball is hydraulically forced off its seat while traveling downward within the down-hole pump assembly. This position is measured within the polished rod total travel. Weight transfer occurs on the down stroke of the pumping cycle. The weight being transferred is the weight of the fluid column which was previously lifted and supported by the closed traveling valve in the pumping cycle. The weight of the fluid column transfers to the tubing string when the traveling valve is forced open. The weight of the fluid column is then supported by the closed standing valve.

TRAVELING VALVE LEAKAGE: Is also called slippage and equates to the fluid volume that slips or leaks past the traveling valve ball and seat plus the volume that slips or leaks past the plunger and working barrel during the course of rod pump operation. Many factors influence traveling valve leakage or slippage as detailed in the background information. Well production, operating costs and potential failures down-hole are all affected by excessive leakage amounts.

STANDING VALVE LEAKAGE: Is also called slippage and equates to the fluid volume that slips or leaks past the standing valve ball and seat during the course of rod pump operation. Many factors influence standing valve leakage or slippage as detailed in the background information. Well production, operating costs and potential failures down-hole are all affected by excessive leakage amounts.

TOTAL WELL LEAKAGE FACTOR: Is also called total well slippage factor. This is the total leakage or slippage of fluid lifted that does not make it to the surface of the well. It includes traveling valve leakage, standing valve leakage and tubing string leakage total amounts of fluids that slip past and also the rate at which they slip past the sealing surfaces.

BOTTOM-HOLE PRESSURE: Is the hydrostatic head pressure generated by the annulus fluid column of the well bore liquids along with any reservoir formation pressures. The total height of this annulus fluid column is directly proportional to reservoir formation pressure and its ability to flow thru the casing perforations. The greater the bottom-hole pressure; the easier the well bore fluids are pushed into the pump inlet thru the standing valve during the pumping intake cycle. As the bottom-hole pressure diminishes, due to decreased hydrostatic head pressure; so does the ability or motive force for the down-hole pump to fully fill the working barrel during the pumping intake cycle within the time allotted. Bottom-hole pressure is usually a calculated value based on the specific gravity and height of the fluid level within the annulus. Pumping a well dry is the same thing as saying the bottom-hole pressure is very low. In a natural gas well liquid level bottom-hole pressure is directly related to natural gas production. High bottom-hole liquid pressures are synonymous to reduced natural gas production levels due to liquid interference.

FLUID POUND: Is the name given by the oil and gas industry to the damaging effect of operating a rod pumping installation with less than full down-hole pump fillage with fluids. Tremendous stress and strain to the entire well installation is caused by fluid pound. Since the pump is not being adequately filled on every intake stroke daily production rates decline in a direct ratio to pump fillage. Weight transfer position is directly proportional to the effect called fluid pound. The higher the weight transfer position the less likely of causing damage to the well installation due to more complete pump fillage.

GAS POUND: Is similar to fluid pound in which the down-hole pump fillage is comprised of a compressible gas instead of being fully filled with fluids. This tends to not open the traveling valve upon rod string and traveling valve reversal to downward motion due to gas being highly compressive. The trapped gas must be pressurized high enough to overcome the traveling valve load. Similar damaging results occur with gas pound also called gas lock as found with fluid pound. Production also suffers due to lack of fluid being pumped.

PUMP OFF: A phenomenon produced when pump submergence below the fluid column within the annulus is low. Also stated as during the pump intake cycle very little fluid enters the down-hole pump. A pump-off situation will likely increase the gas intake within the rod pump itself, thus reducing the pump efficiency, also called gas pound. Operating coal bed methane gas wells near pump off, produces the greatest amount of natural gas up the annulus due to low bottom-hole liquid pressures. With less force acting downward on the coal bed seam the natural gas is able to de-sorb from the surface of the coal surfaces.

WORKOVER: The process of performing major maintenance or remedial treatments on an oil or gas well. In many cases, workover implies the removal and replacement of the production tubing string or rod string or down-hole pump after a failure was diagnosed. The workover process cannot begin until the well has been killed which severely restricts or limits hydrocarbon transfer from the reservoir formation into the well bore.

KILLING A WELL: To stop a well from flowing or having the ability to flow into the wellbore. Kill procedures typically involve pumping higher density fluids into the wellbore to choke off hydrocarbons from entering the well bore, from the reservoir, and traveling to the surface and escaping out the open hole. This same fluid must be re-pumped out of the well bore and formation to reinstate well production once the workover process is completed. There is no guarantee the well will produce as it did prior to being killed.

Artificial lift is used to produce hydrocarbons from an oil or gas well that does not flow to the surface under its own entrained down-hole energy. Rod pumping is one means of adding surface unit energy for producing the well. This introduced surface energy performs work in the form of artificially lifting a subterranean fluid to the surface through the complete oil or gas well installation. The pumped fluids and gases exit the well bore via the well head thru the fluid production and gas production lines.

As existing oil and gas wells can no longer be economically produced using other forms of artificial lift such as ESP or PCP or gas lift or plunger lift or hydraulic lift it is very common industry practice to switch to rod pumping. Due to lowering bottom-hole pressures the other forms of artificial lift are unable as well as not economically feasible to maintain current production levels. As this occurs over the life of a well installation rod pump means are refitted to the same wells which extend the life of production as well as reducing operating costs and allowing the operating company to continue producing hydrocarbons. Rod pumping benefits are well known and documented. However, they must be operated correctly or costly failures will and do occur, which again hinders production and increases the total cost of producing the hydrocarbons from the oil or gas well.

Rod pumping equipment and parts used to produce oil and gas wells can be categorized into simple working groups. Each group or sub-assembly are constructed of many individual components integrated together all acting in unison. The groups combine together to form the complete oil or gas well installation. The four main working groups are; Surface unit, Polished rod and sucker rod string combination, commonly called the "rod string", Production tubing string, commonly called the "tubing string" and Down-hole positive displacement pump assembly. Surface unit converts an input energy source of electricity or chemical energy (combustible fuel) into a useable and controllable force that lifts the polished rod against gravity and lowers the polished rod with gravity while producing an oil or gas well via rod pumping.

Polished rod and sucker rod string combination commonly called the rod string. The polished rod is located on top at the surface of the well, reciprocating within the wellhead. The polished rod seals the top of the wellhead. The sucker rods hang beneath the polished rod and extend downward to the bottom of the well. The rod string assembly is an elastic linear system comprised of many pieces of solid steel or "other material" in the form of long slender rods with male ends along with female couplings which are all threaded and torqued together. The individual components, once connected, form one continuous elastic member connecting the surface unit to the down-hole pump assembly. The rod string conveys surface unit energy to the down-hole pump assembly in the lifting and lowering motion profile; hence powering and controlling the down-hole pump operation. It is very common to have devices called rod guides installed on the rod string attempting to reduce friction down-hole.

The polished rod stroke length defines total linear travel distance measured at the surface of the operating well. All polished rod weights suspended below are measured via the polished rod at the surface of the well. The suspended weight; supported by the polished rod is the combined weight of all sucker rods, sucker rod couplings, rod guides and possibly other mechanical type devices plus the fluid column and traveling valve, explained later. In addition to these weights are all mechanical and fluid frictions minus buoyancy effects of the rod string plus all acceleration and deceleration forces during the lifting and lowering process within the column of fluid throughout the entire oil or gas well installation. The rod string supports the fluid column weight while being lifted.

Production tubing string commonly called the tubing string. The tubing string is also an elastic linear system; comprised of long hollow steel or "other material" tube sections threaded and torqued together with couplings and without couplings. They form a continuous linear conduit in which well fluids are produced via the well head at the surface. The rod string reciprocates within the tubing string. Both elastic systems work in unison sharing the weight of the fluids being lifted to the surface at different times during the pumping cycle. The tubing string supports the fluid column weight while being lowered after weight transfer has occurred.

Down-hole positive displacement pump assembly is located at a predetermined depth near the bottom of the oil or gas well and is mounted common with both the rod string and the tubing string. It is a positive displacement device that pumps a volume of fluids based on each mechanical lifting and lowering motion profile of the polished rod.

Total down-hole pump displacement per pump stroke, also called pump cycle is calculated by the effective area of the plunger reciprocating within the inside diameter (area) of the working barrel multiplied by the traveling valve linear movement. Total pump flow rate is multiplied by the total number of complete pump cycles in a given time period. Pump displacement is typically measured and shown in barrels per day. Oilfield barrels are 42 gallon capacity each; a gallon having 231 cubic inches of volume.

The down-hole pump has numerous components; three major groupings or sub-assemblies for this application are; Traveling valve assembly, Working barrel, Standing valve assembly The traveling valve assembly is a traveling valve attached to the bottom of the rod string and positioned inside the working barrel a ball and seat combination and a plunger. At times, multiple balls and seats are installed in series to further enhance traveling valve robustness. The plunger outside diameter seals against the working barrel inside diameter, aided by the fluid film strength. Varying fluid characteristics down-hole affects this film strength and sealing ability. The dimensional difference of plunger and working barrel is the running clearance of the pump which can change over time by getting damaged with scratches and other forms of damage throughout the operational life of the installation. Both separate entities; balls and seats plus the plunger work together forming the complete traveling valve assembly and referenced as a singular component unless specified differently for the remainder of this document. There are two potential leakage passages past the traveling valve. They are past the balls and seats singularly or plural along with the pump running clearance described previous.

The traveling valve is connected to the bottom of the rod string and reciprocates up and down within the working barrel. As the polished rod is lifted by the surface unit during pump operation a void is created under the traveling valve and within the working barrel. During this lifting motion the fluid column above the traveling valve is trapped, supported and lifted to the surface. The traveling valve seals the bottom of the fluid column weight as the surface unit lifts the polished rod. The traveling valve sealing ability is crucial for proper rod pumping operation. This lifting process is what pulls the fluid column upward producing the well. When the traveling valve leaks during the lifting cycle, the fluid that slips past is not produced at the well head and must be re-pumped back into the fluid column on subsequent pump cycles.

The working barrel is the pump fillage chamber during the lifting portion of the pumping cycle. It is also the high pressure chamber during initial traveling valve lowering portion of the pumping cycle. One complete lifting and lowering pump cycle has a specific volume displacement minus all leakages. The number of complete pump cycles per given time frame creates a flow rate of the well installation as produced at the surface of the well minus what fluids slip past during pumping. When the working barrel allows high pressure fluids to slip past during the pressurization cycle, due to scratches and other damages to the working barrel; those same fluids are not produced at the surface and must be re-pumped in subsequent pumping cycles.

The standing valve assembly is a standing valve anchored to the bottom of the production tubing string via the insert style down-hole pump or tubing style down-hole pump. The standing valve consists of a ball and seat and performs the work of a one way check valve allowing reservoir fluids and gases to enter the working barrel during the intake or lifting portion of the pump cycle and prevents return flow during the pressurization portion and remaining lowering of the pump cycle. As the traveling valve begins to lower, the trapped fluids and gases contained within the working barrel are pressurized, further forcing and sealing the standing valve ball against its seat. As the working barrel pressure level rises and then exceeds the force holding the traveling valve shut; the traveling valve ball is forced open off its seat. This position, measured at the polished rod, is called weight transfer position. WTP is used extensively throughout this document; it is defined as weight transfer position. After the traveling valve ball is forced open and while continuing downward; the newly trapped and pressurized fluid and gas volume within the working barrel enters the fluid column to be lifted to the surface on subsequent pump cycles. When the standing valve allows high pressure fluids and gases to slip past during the pressurization cycle and during the remaining lowering cycle while supporting the fluid column weight those same fluids and gases are not produced at the surface and must be re-pumped in subsequent pumping cycles.

By altering the time allotted to complete one full pump cycle you alter the pump flow rate within the same time allotted. By altering the polished rod stroke hence effecting total traveling valve distance within the working barrel you alter the pump displacement volume per stroke. By adding dwell time while the polished rod is fully lifted and held stationary for a time amount you allow the down-hole pump additional time to fill the working barrel. By reducing total polished rod travel; pump displacement is reduced the same proportional amount, not counting rod string stretch. With reduced displacement down-hole a higher pump fillage percentage of fluid volume may also be increased when fillage percentage is compared to full polished rod travel. If time dwell and stroke reduction are both introduced additional pump fillage assistance and total fillage percentage is increased. By altering the complete number of strokes per given time frame you affect the pump total flow rate within the given time frame. Changing these pump cycle parameters all affect the total pumping flow rate of the complete well installation within a given amount of time. If one could vary these pump cycle operating parameters based on a detectable and known condition one could alter production of the well when the reservoir formation fluid inflow volume to the annulus changes over time either increasing or decreasing.

Simple Down-Hole Pump Operation

Surface unit begins to lift polished rod

Rod string elongates or stretches

Rod string begins lifting traveling valve

As the traveling valve is lifted; the ball is forced into the seat and closes from the weight of the fluid column being lifted The traveling valve seals the bottom of the fluid column being lifted minus the fluid which slips past The fluid column weight is fully supported by the rod string and closed traveling valve The weight of the fluid column has transferred from the tubing string to the rod string during the lifting portion of the pump cycle The polished rod is now supporting the full weight of the fluid column and all steel being lifted by the surface unit As the traveling valve is lifted; a void or low pressure zone is created within the working barrel This is the down-hole pump intake stroke portion of the pumping cycle Standing valve is forced open by the pressure differential caused by height of the fluid level above the pump inlet also called bottom-hole pressure; along with any reservoir formation pressurized fluids and gases available to enter the void just created within the working barrel Surface unit reaches end of lifting portion of pump cycle; whereby polished rod is fully lifted Surface unit begins lowering the polished rod Rod string shortens and compresses due to resistance of movement downward Rod string begins lowering the traveling valve and previously lifted fluid column Traveling valve pushes down on fluid and gases within the working barrel and forcing the standing valve closed Traveling valve continues downward further pressurizing the now trapped fluids and gases within the working barrel and standing valve Rod string continues shortening and compressing caused by additional resistance during pressurization of trapped fluids and gases When sufficient working barrel pressure is generated, the traveling valve ball is forced off its seat and opens When the ball is forced open, off its seat, the fluid column weight transfers back to the tubing string; now fully supported by the closed standing valve, this is weight transfer position (WTP)

Polished rod continues lowering the traveling valve; forcing the trapped fluids and gases within the working barrel, to flow past the now open traveling valve and enter the bottom of the fluid column volume Surface unit reaches end of down stroke, whereby the polished rod is fully lowered Pumping cycle is repeated until surface unit is shut off or failure occurs All fluids which slip past during the pumping cycle are not produced at the well head and must be re-pumped on future pump cycles In addition to crude oil wells, down-hole pumps are used for the deliquifaction of coal bed methane natural gas wells. Methane gas commonly found in a coal bed seam or coal bed; tends to adhere to the local surface of the coal itself while under hydrostatic head pressure caused by the weight of fluids found in the earth pushing down on the coal bed seam. Due to Pascal's Law the pressure is equal in all directions and the amount of force on the coal bed is directly related to the total height and volume of the fluid acting upon the coal bed within the earth. As the coal beds are submerged in these ground fluids, the force acting on the coal via hydraulic pressure causes the methane gas to adhere to the coal itself according to the principle of adsorption. As the rod pumping installation removes this down acting force via lifting these fluids off the coal bed, the hydraulic pressure is temporarily decreased, which allows the natural gas to be released off the coal surfaces.

During rod pumping down-hole pressure is reduced causing the natural gas and associated fluids to flow or travel towards this lower pressure zone via cleats or cracks found within the coal bed seams. These fluids and gases enter the well bore annulus through perforations in the casing below ground and travel up the annulus of the well installation. Some of the gas is conveyed within the ground fluids via the tubing string as both media enter together thru the down-hole pump installation. Typically natural gas flows to the surface of the wellhead via the annulus. The fluids that travel up the annulus help to fill the down-hole pump during the pump intake cycle. The height of these fluids within the lower portion of the annulus is measured via other methods. This hydrostatic head pressure acting on the pump intake is the down-hole pressure. The higher the vertical column is within the annulus the greater the down-hole pressure and vice versa.

As the coal bed is deliquified, the surrounding ground fluids adjacent to the well tend to refill the voids within the coal beds. Ground fluid levels vary for many reasons and the actual re-charging of the same coal bed could be to previous levels or higher or lower without human control over time. As forces reach levels of equilibrium, due to the inflow of the ground fluids, hydraulic pressure again tends to retain the remaining natural gas to the coal surfaces as described above, again choking off natural gas production. However, if the rod pumping installation continues to remove the fluids at a rate that exceeds the ability of the earth to refill the coal bed, the down-hole pressure will continue to decrease, enabling more of the gas to be released and produced thru the well installation.

When the rod pump installation continues to remove ground fluids, at some point the coal bed may be effectively pumped off, not able to fill the working barrel with fluids during the intake cycle, if at least temporarily. Extended operating time of the rod pump equipment without sufficient amounts of down-hole fluid fillage of the working barrel will cause serious damage to the total well installation. These damaging effects are typically called fluid pound. If the surface unit has a method of detecting the varying well inflow conditions and autonomously matching the polished rod motion profile with reservoir inflow fluid rates via adding dwell time at the top of the intake cycle or decreasing the total polished rod travel or combinations of both as well as changing total strokes per minutes, without shutting off, maximum daily gas production is achieved while minimizing the damaging effects of fluid pound by always maintaining full working barrel volumes of fluids.

Mechanically driven and counterbalanced surface units are unable to autonomously adapt to these changing down-hole inflow conditions. They are not able to add dwell time at the top of the pump intake stroke, nor are they able to adjust their total polished rod travel autonomously while operating. The best they achieve is to turn themselves on and off when fitted with run timers. The surface unit operates for an adjustable set period of time on, and then rests idle off for an adjustable set period of time, while the coal bed refills with ground fluids. The equipment will therefore cycle on and off to remove the ground liquids and then allow the liquid level to refill. If they are fitted with pump off controllers and variable speed drives they can adjust between a minimum and maximum strokes per minute, but not without short comings. Rod heavy conditions produce massive over running inertial torque values which must be dissipated into heat or regenerated with additional hardware further increasing cost of installation. If the inertial torque values are not managed variable speed drive high voltage bus faults occur and drive internal overload limiters shut the drive down. Further adding operating costs for dispatching a human to cycle the power on and off at the location to reset the drive plus lost production. During the time the coal bed methane well sits idle, the rod pump equipment not operating, ground fluids refill the coal bed seams, raising bottom-hole pressures, choking off the natural gas produced from the well.

During off time from the previous paragraph and having excessive traveling valve or production tubing string leakage; reduces daily production while increasing daily operating costs. These slippages allow previously lifted fluids to fall back into the well which must then be re-pumped when the surface unit begins operation again. Standing valve leakage during the pressurization cycle; reduces the volume of fluids pumped by allowing working barrel pressurized fluids to flow back into the annulus and reservoir formation instead of forcing the traveling valve open and adding these trapped liquids to the fluid column above the traveling valve. All three leakage factors directly affect total well revenue by reducing daily hydrocarbon production and increasing daily operating costs.

Down-hole pump leakage also called pump slippage or slippage factor or slippage rate affects the daily fluid or gas production volumes and the total well system efficiency, hence costs of operating. Total well slippage factors are made up of individual leakage rates from numerous sub-assemblies within the total well installation. Some of these leakage sources or slippage factors are caused by the traveling valve, standing valve and tubing string. The tubing string is included with the traveling valve test. Performing both traveling and standing valve test methods are required for a complete well slippage test result.

Pump running clearance is the inside dimension of the working barrel versus the outside dimension of the traveling valve plunger. This dimensional difference allows a path of fluid leakage from the fluid column being lifted while supported by the traveling valve ball and seat combination plus the plunger. As fluid slips past, it travels downward back into the working barrel of the down-hole pump. Running clearances are specified at time of ordering or rebuilding of the pump. Running clearances are required for correct pump operation and vary over time of operation and conditions down-hole. Running clearances increase as the life of the down-hole pump increases or gets damaged thru the course of normal operation at varying degrees over time. Tracking these slippage factors over time would allow an operating company to track well performances and allow advanced knowledge for scheduling of workover services (repair) for the total well installation.

Total well slippage or leakage factor is further influenced by numerous well characteristics. Some, yet not limited to, are diameter of pump, length of pump stroke, length of plunger, depth of pump setting, API gravity, type of fluids, water percentage of fluids lifted, sand content of fluids lifted, other contaminants of fluids lifted, life (number of pump cycles) of down-hole pump, condition of down-hole pump and any leakage paths in the production tubing to name a few. In addition to the mechanical reasons stated; time the surface unit is not actively pumping the well provides additional time for the tubing string fluid column to leak into the annulus or past the traveling valve or reservoir formation via the standing valve.

As pumps are set deeper; the fluid column exerts higher hydrostatic head pressures at the bottom of the well increasing pump slippage or leakage factors thru these leak points or pump clearances. As pumps begin to wear; the total slippage or leakage factor increases over time and number of pumping cycles. All of the above conditions directly affect the daily production of the well and hence the total operating cost of the entire oil or gas well installation.

Dynamometry is very common prior art which is accepted and proven within the oil and gas industry today. The technique measures the polished rod motion dynamics in real time while the testing and recording equipment is installed and connected to a rod pumping installation. The well testing process requires specialized equipment and related software and specific human knowledge plus proper step by step human intervention and procedures for correct well testing results. When performed correctly, any rod pumped oil or gas well installation can be verified for proper operation or diagnosed in determining what is not correct.

The process measures and records and analyzes the polished rod motion profile including; weight supported and travel direction and travel velocity and position and acceleration and deceleration forces. In addition electric motor voltage and current readings are simultaneously measured and recorded and over laid on top of the polished rod motion characteristics.

The monitored and translated feedbacks are compiled and output as the surface unit card also called dynamometer surface card or just surface card. It depicts the actual amount of real work during the lifting and lowering motion profile completed at the surface of the complete oil or gas well installation.

The safest way to perform dynamometer well testing includes shutting down the surface unit to install the testing hardware feedback devices. Once the well testing hardware is installed, the surface unit is re-started and test data is recorded. Different well tests have varying test procedures or test processes. After a designated run time or number of pumping cycles for the duration of the well tests; the surface unit should be shut down for safely removing the well testing hardware. Sometimes the testing equipment is installed and removed while the surface unit is running but that is not typically the safest operating practice.

Basic Steps for Traveling Valve Test as Performed Using a Dynamometer

The technician performing the slippage test must enter all well bore data into the tailored computer and software of the dynamometer testing system in order to produce accurate testing results If the entered information is not correct it will directly affect the testing results All remaining steps are human managed and performed Surface unit is shut off Dynamometer testing system feedback devices are installed Surface unit is re-started and correct feedback operation is verified It is very common practice to record several minutes of actual pumping operations for analyzing the polished rod motion dynamics as well as determining where WTP is occurring While the polished rod is being lifted Surface unit is switched off Simultaneously the human sets the mechanical braking device Not setting the brake quick enough may allow the rod string to fall downward possibly damaging the well installation Polished rod is held stationary by the braking device, if it moves the test results will be affected The manually installed dynamometer testing system monitors the polished rod motion profile along with supported weight for the designated time amount During this time amount the polished rod supported weight decays at a rate measured over time of the test Based on the previously entered well bore details a leakage rate is determined of the traveling valve All testing feedback devices are removed Surface unit is re-started or a standing valve test is performed next If the standing valve test is required weight transfer position must be determined prior to performing standing valve test Standing Valve Test as Performed Using a Dynamometer The same well bore data is used for the standing valve test.

Dynamometer testing system feedback devices are still installed and operating correctly Surface unit is pumping the well Weight transfer position is determined with the data collected previously All remaining steps are human managed and performed It is very common practice to record several minutes of actual pumping operations for analyzing the polished rod motion dynamics plus double checking where WTP is occurring While the polished rod is being lowered After weight transfer position has occurred which is either a guess or information interpreted during a previous monitoring run is used Turn off the surface unit Simultaneously setting the mechanical brake Not setting the brake quick enough may allow the rod string to fall downward possibly damaging the well installation Polished rod is held stationary by the braking device, if it moves the test results will be affected The manually installed dynamometer testing system monitors the polished rod motion profile and supported weight for the designated time amount During this time amount the polished rod supported weight increases at a rate measured and recorded over time of the test Based on the previously entered well bore details a leakage rate is determined of the standing valve Surface unit is switched off All testing feedback devices are removed Surface unit is restarted Specialized hardware and software along with specific manual techniques and procedures are both required to perform traveling valve and standing valve dynamometer card well testing, both are tested per well for a complete test. Having these tools, plus a technician with the training required is essential to properly evaluate the entire rod pumping installation for operating efficiency and for testing the leakage or slippage rates of the entire well along with diagnosing well short comings which could lead to pending equipment failures.

A typical piece of testing hardware is a polished rod transducer; which attaches to the outside diameter of the polished rod. Another transducer style is installed in a way that fully supports the rod string weight. Both devices when properly installed measure working conditions, also called polished rod motion profiles, in both directions of travel. The measurements include polished rod supported weight in pounds force, position, total distance traveled, direction of travel, velocity, acceleration and deceleration forces. All these motion parameters are monitored, analyzed and recorded both while lifting and lowering over the course of testing time while the surface unit is operating and the testing system is installed and recording data.

English units of measure are typically pounds force, both in static and dynamic weights or loads along with acceleration and deceleration gravity (G) forces due to movement over time of actual supported loads. Time is measured in seconds to a very fine degree having capabilities down to 0.001 second loop scan where all feedbacks are recorded every loop scan and collated independently for complete motion profile evaluation. Total polished rod travel distance measured over entire pump cycle up and down typically displayed as inches. The metric system is available as well. Units of force and distance are both able to resolve to 0.1 decimal place.

Electric motor data is observed and recorded during same testing process. Typical electric motor hardware feedbacks are voltage and current measurement. They are installed on the electric motor leads common to the supply power grid. Other electric parameter readings could be lagging and leading power factors and kilowatt use-ages. These measurements could be both instantaneous and per hour among others and able to resolve to 0.1 decimal place.

All feedback devices are connected via wires or cables to a tailored monitoring and recording computer device with purpose built software. The real time data feedback streams are time stamped per scan segment and all data input channels are read, stored, analyzed and manipulated simultaneously. All feedback data streams are available for studying the measured values as they occurred during the time the hardware is installed on the surface unit but only during the testing process is data available. After the well testing is completed the equipment is removed and normal operation is reinstated without any of the fine degree of measurements available.

Due to the difficulty and expense required to measure the actual conditions in the bottom of the well installation where the down-hole pump is installed, a mathematical formula commonly called the wave equation is used to infer down-hole pump operating conditions. The wave equation is also a prior art form and the oil and gas industry accepted standard. The wave equation has numerous forms, often modified and or managed differently by others in performing certain tasks as required by others.

The wave equation is a complex mathematical process which allows for a semi-predicable solved output when a known bi-directional force (lifting and lowering) in an applied direction plus applied amplitude plus rate of change is introduced to the polished rod at the surface. The resulting inferred output of the non-supported opposite end of the elastic rod string is then a calculated output value. These calculated values include but not limited to traveling valve distance both up and down. Forces applied to the traveling valve both up and down. Both of these calculated value streams are dynamic and time based during the rod pumping cycles. Stated another way is that the bottom of the rod string lags behind the top of the rod string for both lifting and lowering the polished rod and because it lags behind pump under travel and over travel occurs where the traveling valve does not move the same amount as the polished rod and the wave equation attempts to predict down-hole conditions such as pump fillage percentage among others.

In order to produce the requested accurate output of the wave equation; complete and accurate well bore diagram information with all respective rod string, tubing string, down-hole pump component sizes, lengths, diameters, types, configurations, pump setting depths, fluid type specifics, water percentage, gas percentage, deviated, directional or straight well type configurations all must be entered in the above mentioned tailored computer and software system.

The inferred output is typically called the "down-hole pump card", "dynamometer down-hole pump card", or just the "pump card". Un-like the surface unit card, the down-hole pump card depicts the inferred amount of real work completed at the bottom of the oil or gas well total installation based on the wave equation in addition to all user input data of the well bore diagram.

Through the process of well testing using a dynamometer; a person skilled in the art of dynamometry can properly diagnose and determine the reason why a well produces poorly or mechanically fails often. One can also verify correct operation in a normal producing well as a means of routine system operating inspection or record keeping or tracking for the life of a well installation, which could trend a pattern of mechanical failures versus production or other statistical data. The above described well testing data or process is only available while and during the testing hardware and software and trained technician are present and running on the specific well installation. Dynamometer testing equipment is not designed for permanent well installation.

Total well installation operating deficiencies represented could be yet not limited to: reduced down-hole pump fillage capacity or rates of fillage, pumped off well condition, parted rod string down hole, out of balance conditions in the surface unit, over or under loaded surface units, production tubing leakage, traveling valve leakage, standing valve leakage among numerous other production hindering well attributes. All of which directly impact the operating company's total cost of producing an oil or gas well.

For dynamometer testing, technician intervention is required for performing the required mechanical and electrical connections plus proper procedural operation such as stopping and setting the brake of the surface unit during the correct portion of the pumping cycle and for releasing the brake and re-starting the surface unit correctly to prevent damaging the surface unit upon completion of leakage or slippage tests. All well specifics unique to each well site must be entered into the proprietary software for performing well testing and producing the surface card plus the inferred down-hole pump card. Substantial technician effort and coordination in correct sequences of operation plus safety procedures and resultant costs are required for a well to be properly and safely tested using a dynamometer. Due to these costs it is common that wells are only tested when a problem is suspected or production rate declines or stops due to a failure of some type.

The well testing data derived from a dynamometer test is not currently nor typically, used to autonomously adjust the existing surface units used today. These surface units include both mechanically counterbalanced designs and hydraulically operated designs with or without high pressure nitrogen gas used for counterbalance. Changing total polished rod stroke travel or changing the mechanical counterbalance weights requires physical alterations of the surface unit plus heavy lifting equipment and adding or removing heavy counterbalance masses plus more manual human effort. If final drive speed reductions are desired to affect global strokes per minute, mechanical hardware reconfiguring of the surface unit is required by changing the running diameter of the driven sheave or driver sheave or both. These additional human produced changes could also include adding or subtracting nitrogen gas pressure volume for changing the counterbalance effect in some existing hydraulically powered surface units today.

The pumping speed of surface units predominantly in use today typically can only be varied between a designated minimum and maximum speed or be varied by varying run time versus off time of the surface unit. These simple variables are accomplished with additional control or powering equipment such as pump off controllers plus variable speed drives with or without over-running load reactors or just simple run timers. In the case of an installed pump off controller plus variable speed drive with or without over-running load reactors; gross load changes are able to be determined using many different means of prior art in the form of load plus designated positions plus time and the varying time amounts from cycle to cycle and current sensors while the surface unit is operating.

The foregoing do not provide for dynamometer accuracy but rather are gross means of detecting and preventing the damaging effect of fluid pound as reservoir down-hole conditions change.

The following are objectives of the present invention

Autonomously perform traveling valve or standing valve slippage tests

Autonomously transmit well slippage or leakage factor test results locally or externally Autonomously detect weight transfer position and self adapt to changing well in flow conditions or lowering fluid levels within the annulus also caused by varying reservoir inflow conditions Using the slippage test data with other data to self adjust rod pumping motion profile by adding a dwell time at the top of the polished rod travel (pump intake stroke) based upon weight transfer position trending lower from previous pump cycle or average of previous pumping cycles. The added time value allows additional time to fill the working barrel during the pump intake duration Using the slippage test data with other data to self adjust rod pumping motion profile by decreasing or removing a dwell time at the top of the pump intake stroke based upon weight transfer position trending higher on previous pump cycle or average of previous pumping cycles Using the slippage test data with other data to self adjust the running counterbalance values so lifting and lowering the rod string is always in balance, hence not over loading the surface unit or causing high voltage faults or wasting electrical energy thru resistor banks when variable speed drives are used to regulate total strokes per minute Using the slippage test data with other data to self adjust by reducing the polished rod total travel amount based on weight transfer position from previous or average of previous pump strokes trending lower; this allows for complete working barrel tillage which reduces the damaging effects of fluid pound Using the slippage test data with other data to self adjust by increasing towards maximum polished rod total travel amount based on weight transfer position from previous or average of previous pump strokes trending higher; thus allowing more well production Using the slippage test data with other data to self adjust the top and bottom direction-change position to accommodate worn down-hole pump conditions as determined by the slippage tests Using the slippage test data with other data to self adjust the acceleration and deceleration rates prior and after direction-change occurs to reduce the stress and strain on the rod string

SUMMARY OF THE INVENTION

The method and system described herein may be incorporated with a surface unit capable of the following:

Ability to stop and hold position autonomously at any command-able point of polished rod travel while either lifting or lowering the polished rod upon an initiation commanded prompt. The stopping and holding would be for pre-selected time duration.

During this process of stopping and holding the polished rod stationary, the surface unit must be able to autonomously and accurately measure the actual polished rod position versus the commanded polished rod position.

While at this commanded stop position; the polished rod weight supported must be able to be autonomously and accurately measured initially upon stopping of motion and having the ability to ascertain the total amount of increasing or decreasing weight being supported by the polished rod plus rate of weight change over the pre-selected time duration.

Autonomously able to vary total polished rod travel amount of the pumping cycle

Autonomously able to increase or decrease the lifting and lowering speeds separately, without penalty of minimum operating speed of electric motor ability to self cool, during the pumping cycle without wasting electrical energy over resistor banks and without causing high voltage bus nuisance faults of variable speed drives Autonomously able to vary both the top and bottom stopping and direction reversal positions during the pumping cycle Autonomously able to stop the polished rod and add a designated time dwell while at the highest point of lifting during the pumping cycle The above system as being described in patent pending application #7077-011

This invention provides two independent yet mutual testing methods for autonomously performing the traveling valve and standing valve slippage or leakage tests of a rod pumped well installation. Both the traveling valve and the standing valve test methods may be performed individually or in succession when triggered. The test methods may be automatically cycled one after the other upon completion of the first test. A number of normal pumping cycles (for example 10) are performed between each test method to allow for down-hole stabilization. Both testing methods allow the well operating company to realize the benefits of well testing on a real time information basis, without the expense or time delay of a technician traveling to the well location and correctly performing the testing procedure, collating the testing data and reporting the testing results. Additional definitions used in the remaining application are as follows:

AUTONOMOUS: Self-Governing, independent, not subject to control from outside, capable of some degree of self-sufficiency, ability to perform decision making, without external human guidance or assistance or operation, having the ability to respond to varying conditions for the purpose of attempting to correct the deficiencies as determined during the course of powering and controlling and operating a rod pumped oil or gas well without human intervention AUTONOMOUS DWELL TIME (ADT): Is a pumping cycle when the polished rod is held at the highest elevation and held stationary for autonomously adjusted time period. The autonomously adjusted time period is based upon weight transfer position of the previous pumping cycle or average of pumping cycles being lower as measured within polished rod travel. The additional time provides the down-hole pump an increased time period for well bore liquids to fill the working barrel. When weight transfer position increases in height as measured within polished rod travel, the autonomously installed time dwell at the top of stroke automatically decreases or is removed entirely, thus increasing the pumping rate of the down-hole pump.

AUTONOMOUS POLISHED ROD TRAVEL (APRT): Is the variability of the surface unit to autonomously regulate and accommodate a reduced travel amount of the polished rod based upon weight transfer position of previous pumping cycle or average of cycles being lower in the measured polished rod travel. The reduced polished rod travel amount is required if the down-hole pump is not filling the working barrel within the given amount of time during the pumping cycle. By autonomously reducing polished rod travel one reduces the down-hole pump displacement by limiting pump travel. As weight transfer position increases as measured within polished rod travel, the surface unit autonomously adjusts by increasing polished rod travel to accommodate the increased fillage rate of the working barrel, thus increasing down-hole pump displacement.

WIND LOAD AUTONOMOUS POLISHED ROD TRAVEL (WLAPRT): Is the variability of the surface unit to autonomously regulate and accommodate a reduced travel amount of the polished rod based upon wind speed increasing as measured at the well location. High wind speed adds additional side loading force to the fully extended surface unit while lifting the polished rod. This additional side force hinders the load rating of the surface unit. As wind speed decreases and stays at the lower velocity for a preset at factory time period (for example 10 minutes) the surface unit autonomously increases the polished rod stroke to achieve optimal production. As wind speed varies at the well location the surface unit autonomously defaults to the reduced stroke safer operating condition.

AUTONOMOUS STROKES PER MINUTE (ASPM): Is the variability of the surface unit to autonomously regulate and accommodate total lifting and lowering velocity and frequency of the polished rod based upon previous weight transfer position or average of previous pumping cycles being lower or higher as measured within polished rod travel. When weight transfer position is autonomously determined to be lower than previous as measured within polished rod travel, the surface unit reduces the total strokes per minute autonomously. When weight transfer position is determined to be higher as measured within polished rod travel, the surface unit increases the frequency of lifting and lowering the polished rod up to the maximum speed allowed. When the down-hole pump is completely filled with liquid while traveling the maximum linear amount and cycled at the maximum speed, fluid production is at a maximum rate. The lifting versus lowering speed is autonomously regulated independent of one another during the strokes per minute changes stated above. Surface unit input and output horsepower is affected by lifting and lowering polished rod loads and travel velocities against and with gravity. The surface unit autonomously regulates the total power consumed for lifting and regenerated for lowering within user preselected values which coincide with the total installed prime mover horsepower rating.

PUMP CYCLE OPTIMIZATION (PCO): The surface unit autonomously performs well leakage tests, which requires determining of weight transfer position from the previous pump cycle or average of pumping cycles measured and recorded from polished rod travel, and then autonomously determines which operating characteristic to vary to influence raising WTP for subsequent pump cycle or average of pump cycles:

Perform autonomous traveling valve leakage tests based upon initiation event

Perform autonomous standing valve leakage tests based upon initiation event

Integrate the test results into the remaining polished rod motion control to limit ADT within user preselected range of operation Integrate the test results into the remaining polished rod motion control to limit APRT within user preselected range of operation Integrate the test results into the remaining polished rod motion control to limit ASPM within user preselected range of operation Transmit test results along with current operating parameters on a regular scheduled time as well as having it available locally at the well site Add or subtract dwell time (ADT) at the top of polished rod travel to increase WTP or pump fillage percentage Reduce or increase total polished rod travel (APRT) to increase WTP or pump fillage percentage Reduce or increase total strokes per minute (ASPM) to increase WTP or pump fillage percentage Regulate lifting speed versus lowering speed independently to consume or generate a predetermined maximum amount of prime mover energy. This could be supply voltage current or regulating the operating speed on an internal combustion engine. By regulating the total horsepower of the rod pumped well installation prime mover overloads are prevented.

Well testing procedures may be triggered by any of the following initiation events, or others selected by the well operating company Manual command prompt triggered locally at the well site or remote via communications protocol.

Pump cycle count down; once a pre-selected number of pumping cycles has occurred since last test.

Time elapse; once preselected time duration has occurred since last test.

Testing initiated based upon a decaying daily production variance. This variance is measured and selected from a downward trending weight transfer position as measured during the standing valve tests in addition continually monitoring and recording for production increase capabilities.

All well testing and operational data may be available in password protected electronic formats. Information may be made available locally at the well site or may be remotely transmitted, to a pre-selected designation via communications network protocols on a regularly scheduled interval, or any time requested locally or remotely after password access is granted, or both.

Because well testing must be available at any time if a manual command prompt is to be allowed, a preferred embodiment of the method of the present invention performs weight transfer position logging every pump cycle. This known and recorded position is required when performing an autonomous standing valve test. The polished rod stopping position must be on the down stroke and after weight transfer has occurred to the tubing string.

Well slippage factors may be autonomously and seamlessly integrated or factored into controlling the surface unit operation of lifting and lowering the polished rod under closed loop position, force, velocity and motion control which powers and controls the down-hole pump in the most efficient manner possible. If excessive leakages or slippages are detected the method adjusts ADT, APRT and ASPM. The maximum leakages allowed may be user selectable and predefined during initial commissioning of the surface unit.

Embodiments of the method of the present invention of operating a surface unit and complete rod pumped well installation may autonomously perform, report and integrate total well slippage test results and may provide the option to tailor the surface unit polished rod motion profile to operate the well with the highest percentage of working barrel fillage of liquids or to override the pump fillage optimization and run with preselected user inputs.

The dwell time and polished rod travel distance adapting is based off of previous and average of previous pumping strokes. By continually monitoring and adjusting the surface unit operation autonomously the method maintains or increases the height of weight transfer position or percentage of pump fillage adding dwell time or reducing polished rod travel or combination of both. This provides for optimizing production level along with lowering overall operating cost and minimizing well breakages, by maximizing working barrel fillage volume of fluids.

The operating company also has the ability to over-ride the autonomous controls and input commands to produce the well with user preselected inputs to regulate:

Dwell time amount or no dwell time at the top of polished rod stroke

Total polished rod travel between a minimum and a maximum linear amount

Strokes per minute between a minimum and a maximum based on installed horsepower of the surface unit Defined top position and defined bottom position where travel direction reverses during lifting and lowering of the polished rod Defined top and bottom positions where deceleration begins for the appropriate direction of travel Manual initiation of traveling valve test locally on well location or remotely via communication protocols Manual initiation of standing valve test locally on well location or remotely via communication protocols Remote monitoring and transmission of current and previous pumping cycles actual conditions and weight transfer positions The foregoing and other objects, features and advantages of the invention will become more readily apparent from the following detailed description of a preferred embodiments of the invention which proceed with reference to the accompanying drawings.

Within the description of the embodiments are methods to autonomously test the rod pump leakage as performed during the course of producing the well. The autonomous methods perform testing procedures, in specific manners of operation to determine a rate of change. This rate of change is the slippage factor for the complete well installation. For highest accuracy of testing complete well bore diagram information should be entered in the surface unit. If the information is not available or accuracy of is questionable, rates of change will illustrate differences of well testing results over time the well is produced. These changes would be used by the operating companies in assessing down-hole well pumping conditions moving forward.

The slippage factors include; traveling valve, standing valve and production tubing string leakage rates. In order to properly test the standing valve leakage, weight transfer position must be known. Due to the method description of always being able to perform this test when prompted to do so, weight transfer position is determined and recorded every pump cycle. Ascertaining this weight transfer position produces an additional benefit. It is an indicator of working barrel fillage percentage of fluids which have a higher bulk modulus as compared to gaseous media. Stated another way fluids don't compress as easily as gases do.

As the polished rod is lowered the traveling valve continues to lower. The trapped pressurized fluids and gases, within the working barrel, eventually surpass the fluid pressure generated by the fluid column weight, within the tubing string, above the traveling valve. This elevated pressure, within the working barrel, is what forces the traveling valve ball off its seat. As the traveling valve is forced open and continues to lower these trapped fluids and gases within the working barrel enter into the lowering fluid column and are fully supported by the standing valve. The rate at which the working barrel pressurizes as the polished rod is lowered; is direct correlation to the amount of entrained gas within the swept volume of that particular pump fillage cycle. The more gas present the longer it takes in polished rod travel to pressurize and force the traveling valve ball off its seat. This is called gas interference at the pump inlet.

When weight transfer position increases, or trends higher when averaging, as measured by the surface unit on the polished rod travel, it is likely that the reservoir inflow of fluids has also increased within the annulus. As weight transfer position decreases, or trends lower when averaging, it is likely that the reservoir inflow of fluids has also decreased within the annulus. Gas interference percentage can be detected in a similar fashion by the rate of pressurization versus polished rod travel. The more polished rod travel required to off seat the traveling valve the higher percentage of gas within the working barrel. The weight suspended by the polished rod will change at a comparable rate of decay as the higher gas concentration is pressurized. When the working barrel is completely filled with fluid, which is nearly non-compressible, the rate of change will be much quicker during weight transfer. Hence this method of testing and controlling and powering the down-hole pump also provides the knowledge of down-hole conditions to optimize the rod pumping installation as performed autonomously. Once the well testing procedures are initiated, performed and completed the results are autonomously transmitted to awaiting personnel within the operating company or displayed locally upon password acceptance.

The method of controlling and powering the rod pump is accomplished by controlling and powering the lifting and lowering of the polished rod at the surface. Through the surface unit control polished rod position and weight suspended is constantly monitored and recorded during operation. Position is measured to a very fine degree throughout total polished rod travel to 0.010" or less. The weight suspended is measured to a very fine degree down to 0.1 lbs or less. These feedback signals of the surface unit are measured, stored and analyzed every 0.001 second during rod pump operation.

The down-hole pump testing sequence is triggered off of any one of four command prompts:

Manually triggered at the well site location or manually triggered via remote communication protocol After an adjustable and pre-selected number of pumping cycles has occurred the surface unit autonomously performs the testing procedure.

After an adjustable and pre-selected time allotment in hours of pump operation has occurred the surface unit autonomously performs the testing procedure.

After an adjustable and pre-selected production decrease measured in the actual position of where weight transfer occurs. The surface unit autonomously performs the testing procedure.

DETAILED DESCRIPTION

Figure 1:
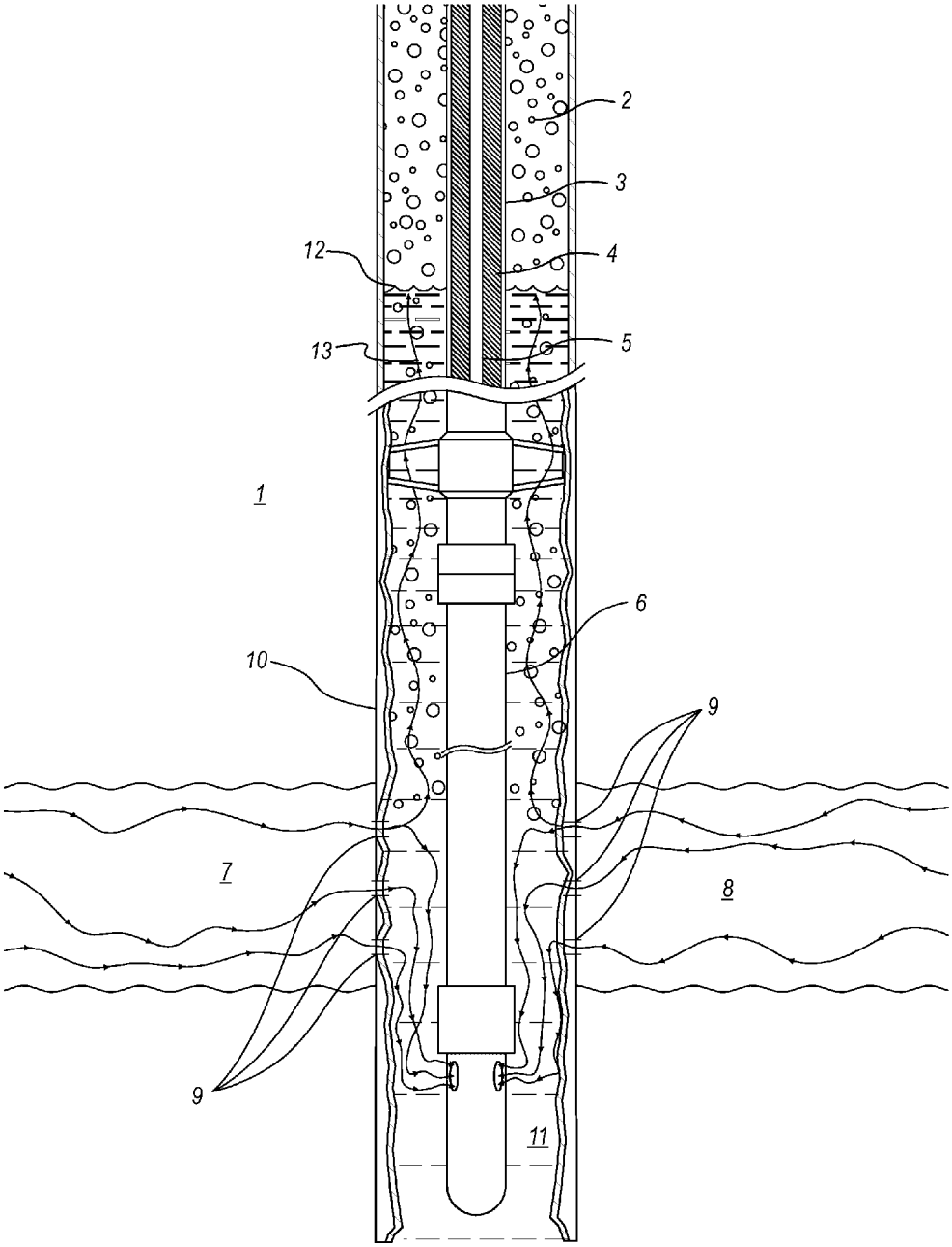
FIG. 1 Illustrates a down-hole pump typical installation within the earth

FIG. 1 illustrates an example of the down-hole pump installation, the down-hole pump assembly 6 installed within the casing 10 as drilled and installed within the ground where the reservoir formation 1 is found. The down-hole pump assembly 6 draws reservoir formation fluids and gases from within the annulus 11 via the casing perforations 9. The casing perforation 9 details and depths along with pump assembly 6 are determined by the operating company and placed during the well installation within the reservoir formation 1.

The down-hole pump assembly 6 produces a pumping action as rod string 5 is lifted and lowered. The pumped fluids exit within the fluid column 4 within the production tubing string 3. During the pumping process some gases may also be conveyed via the pump and enter the fluid column 4. Natural gas is produced at the surface from the well via the annulus area 2 found above the annulus fluid level 12. The annulus fluid 13 enters the annulus area 11 via the perforations 9. The pump setting depth 8 is unique to each total well installation and reservoir formation producing zone or zones 7.

Figure 2:
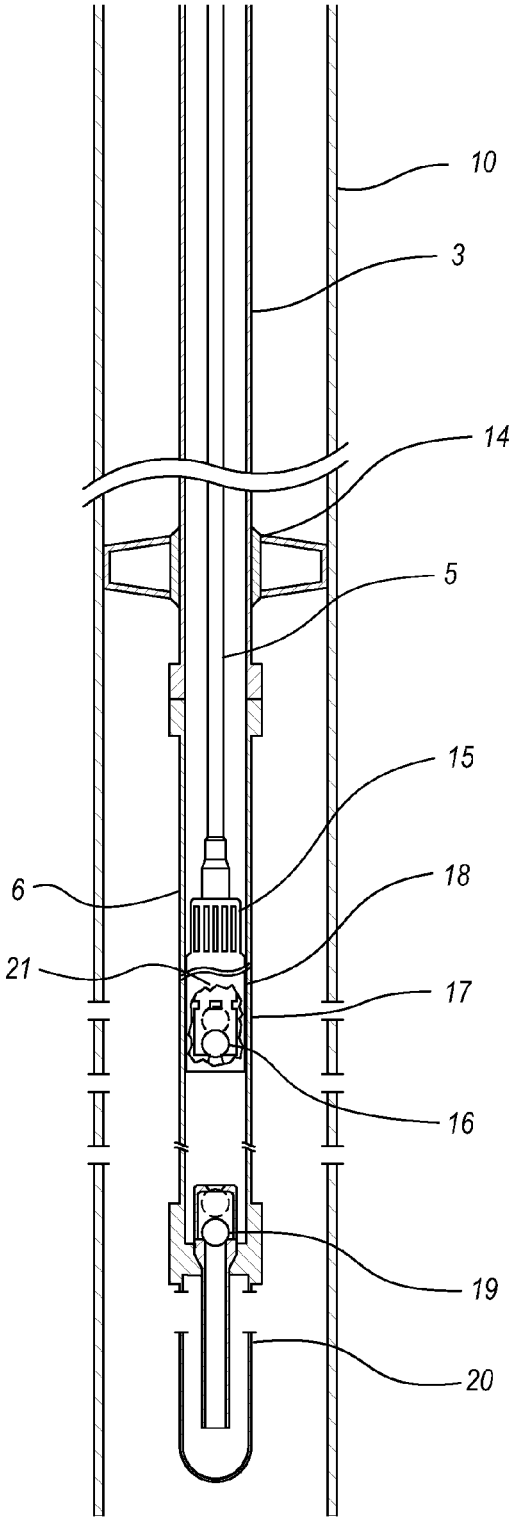
FIG. 2 Illustrates the down-hole pump working group identifications

FIG. 2 illustrates the working groups of the down-hole pump assembly 6 as found within the well casing 10. The tubing string 3 is centrally located within the well casing 10. The tubing string is sometimes anchored via tubing anchor 14, but not always. The rod string 5 reciprocates and is centrally located within the tubing string 3. The plunger 15 is half of the traveling valve 21. The other half of the traveling valve is the ball and seat combination 16 found within the plunger 15. The plunger 15 is centrally located within the working barrel 17.

The plunger 15 outside diameter versus the inside diameter of the working barrel 17 is the pump running clearance 18. The plunger 15 and traveling valve ball and seat combination 16 reciprocates up and down via the rod string 5 within the working barrel 17 during pumping operation. The standing valve 19 is found above the gas separator 20.

Figure 3:
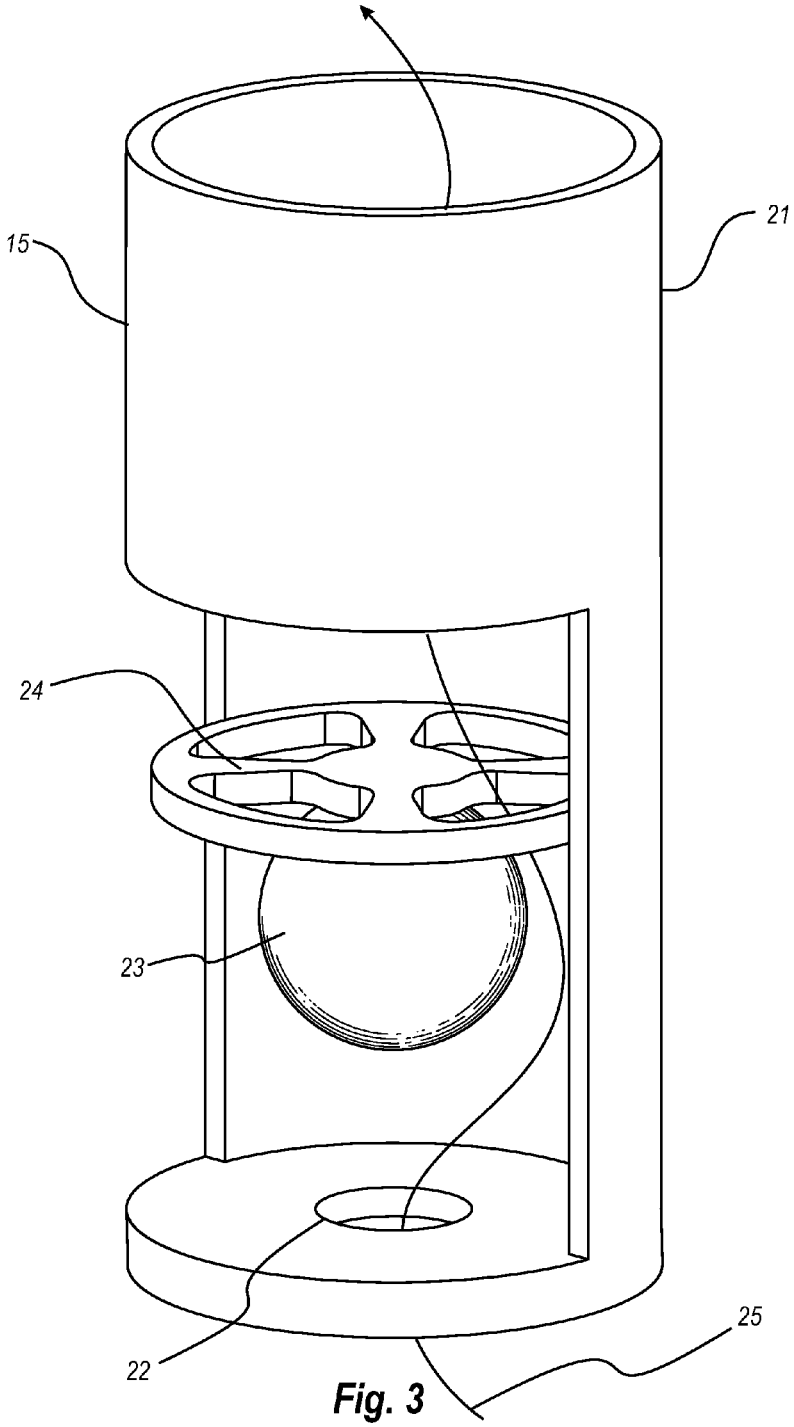
FIG. 3 Illustrates the traveling valve in cutaway form

FIG. 3 illustrates the traveling valve 21 in cut a way form. The traveling valve 21 consists of the plunger 15 with the traveling valve seat 22 and the traveling valve ball 23. The ball cage 24 traps the ball from leaving the traveling valve and allows reservoir fluids and gases 25 to pass thru the traveling valve 21 during pumping operations. The traveling valve assembly is shown in the open state, ball 23 off the seat 22, this is after weight transfer has occurred and the traveling valve is adding fluids and gases to the fluid column above it.

Figure 4:
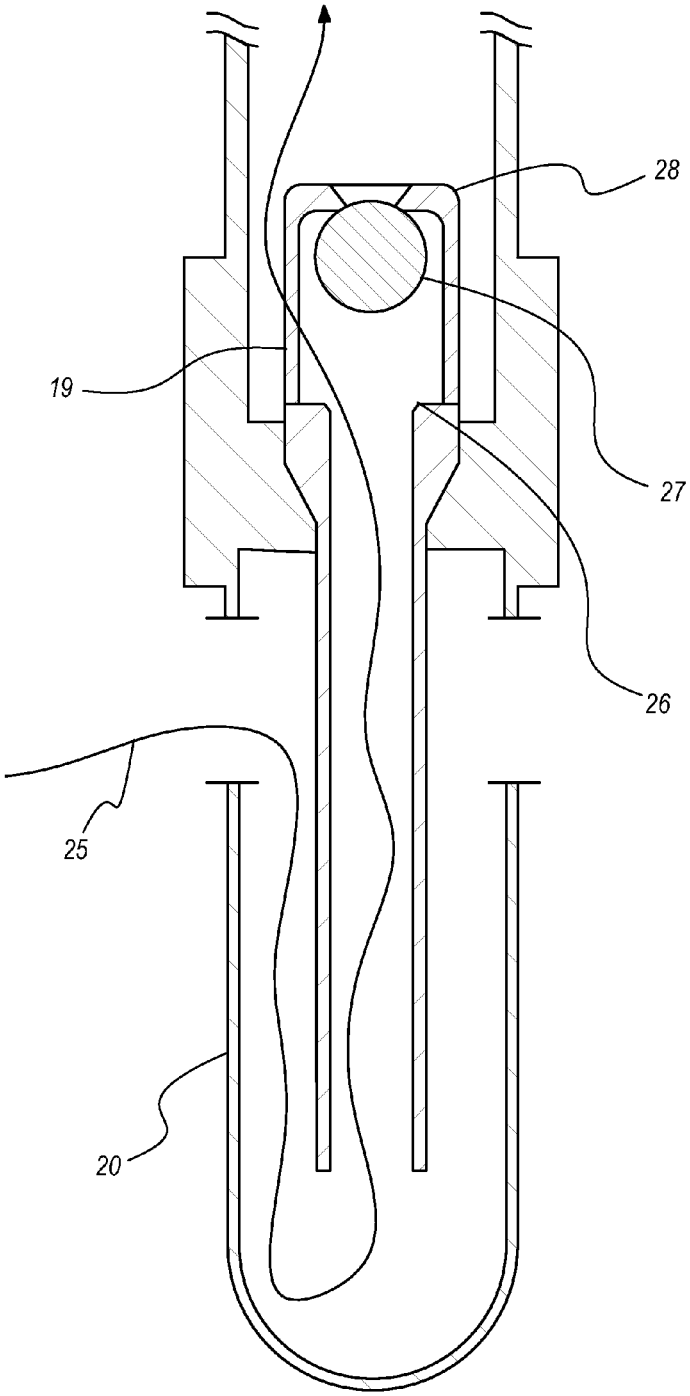
FIG. 4 Illustrates the standing valve in cutaway form

FIG. 4 illustrates the standing valve 19 in cut a way form. The standing valve consists of the standing valve seat 26 and the standing valve ball 27. The ball cage 28 traps the ball from leaving the standing valve 19 and allows reservoir fluids and gases 25 to pass thru the standing valve 19 on the intake cycle, as shown with ball 27 off its seat 26. The standing valve assembly prevents back flowing during the compression cycle of the pumping operations with the ball 27 forced unto the seat 26 during compression and remaining lowering pump cycle. The gas separator 20 aids in separating reservoir formation gases from reservoir formation fluids during pumping operations.

Figure 5:
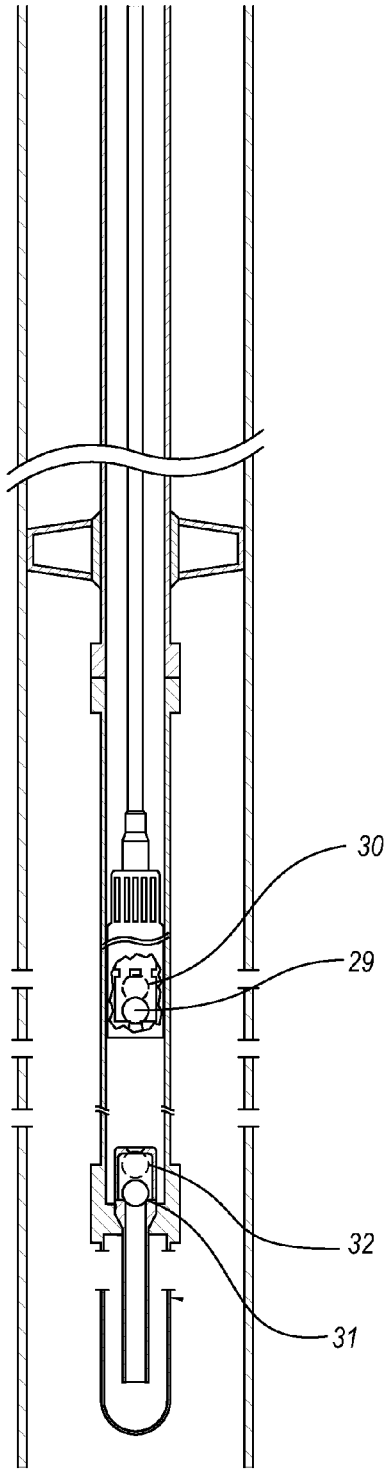
FIG. 5 Illustrates the traveling and standing valve working positions

FIG. 5 illustrates the four independent positions of the traveling valve and standing valve balls. The traveling valve has two distinct positions TV1 29 and TV2 30. TV1 29 is shown with the ball on its seat during the lifting portion of the pump operation. TV2 30 is when the ball is off its seat during the lowering portion and after weight transfer has occurred during pumping operations. The standing valve has two distinct positions SV1 31 and SV2 32. SV1 31 is shown with the ball on its seat during the pressurization and lowering cycle. SV2 32 is when the ball is off its seat during the lifting cycle which is also the filling cycle of the working barrel during pumping operations.

Figure 6:
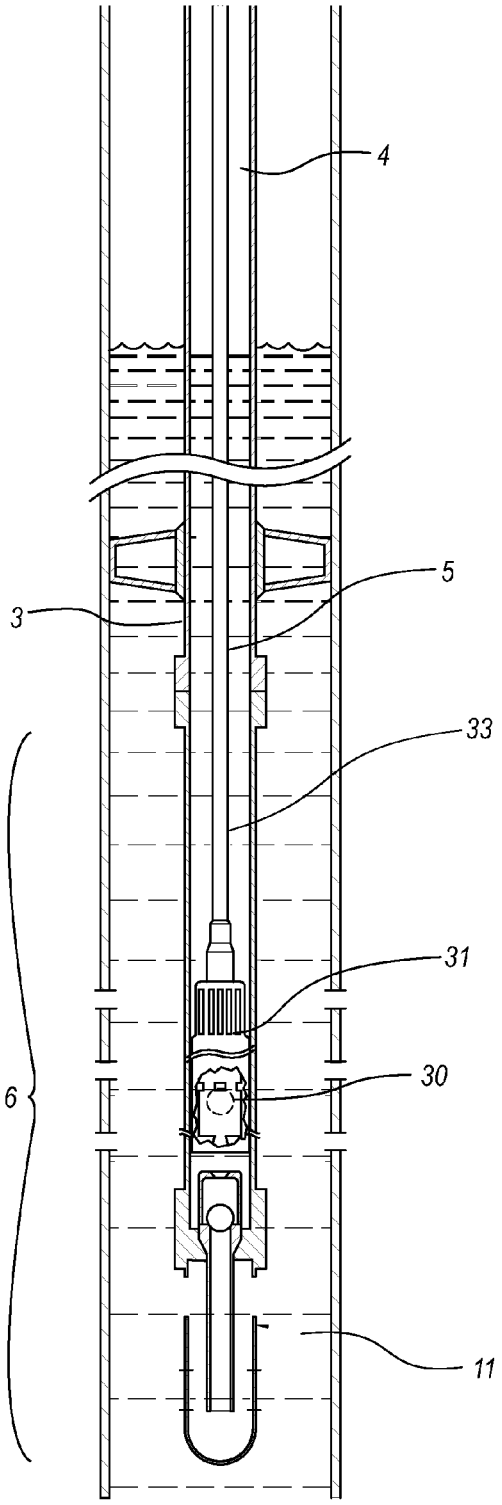
FIGS. 6-11 Lifting polished rod during intake portion of pump cycle

FIG. 6 illustrates the down-hole pump assembly 6 in operation starting at the fully lowered position 33 of the rod string 5. Fluid column 4 has just increased its volume due to the previously trapped and pressurized working barrel volume overcoming the force acting on the traveling valve ball and pushing the traveling valve ball off its seat into position TV2 30 open. The standing valve 19 and the production tubing string 3 are fully supporting the weight of the fluid column 4. The standing valve ball is forced into position SV1 31 closed and sealing the fluid column 4 against back flowing into the annulus 11.

Figure 7:
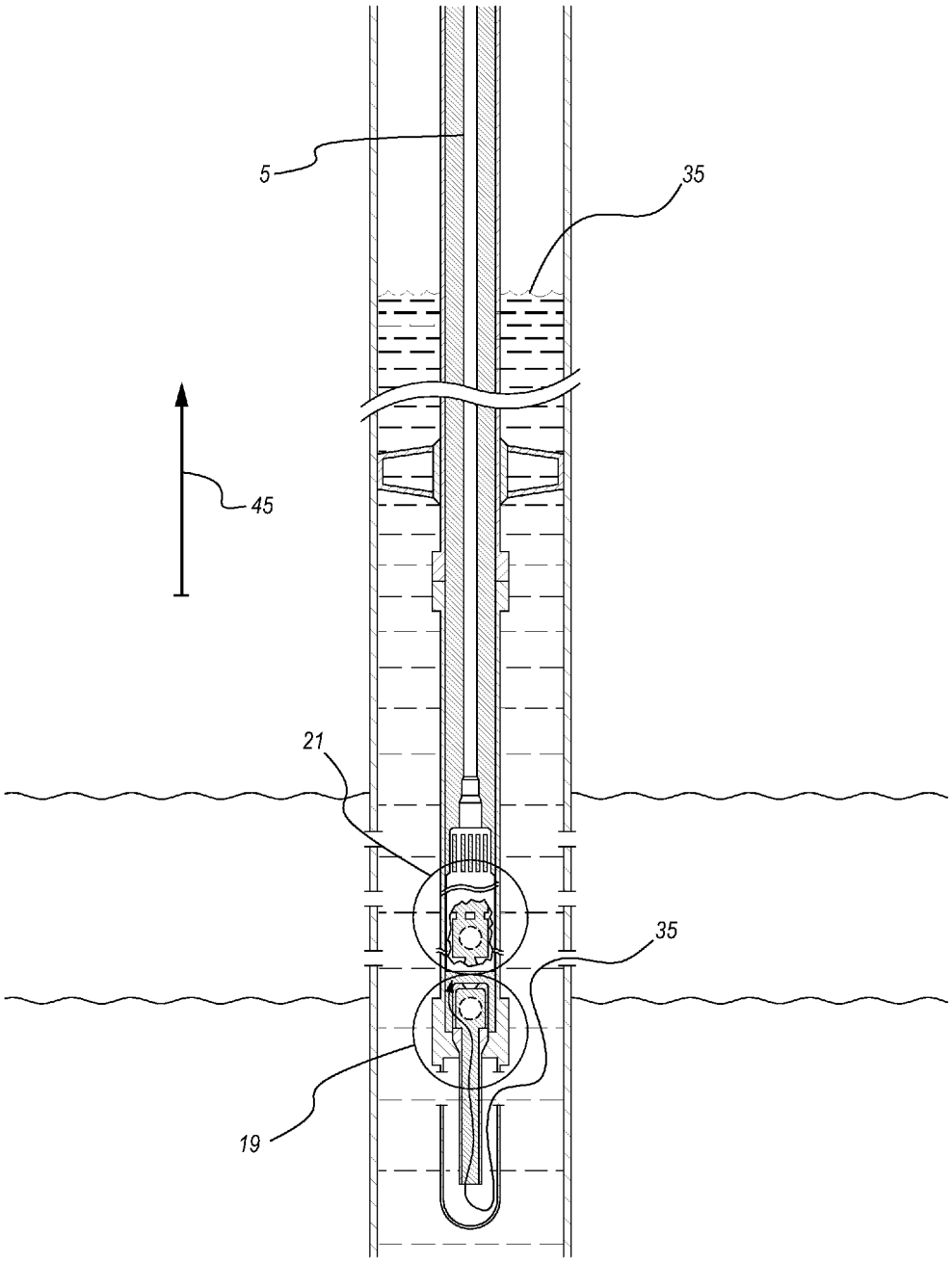

FIG. 7 illustrates the beginning of the down-hole pump intake portion of the pump cycle, it is the transitional time when the polished rod not shown has started to be lifted by the surface unit not shown, the rod string 5 is stretching from the top down, when the stretching stops and motion is detected at the traveling valve 21 the traveling valve ball begins to move downward towards the seat as illustrated in position TV1 29 closed in FIG. 5. The standing valve 19 also is transitioning to position SV2 32 open as motion 45 is detected of the traveling valve 21. Annulus fluid column plus reservoir fluids and gases 35 attempt to force the standing valve ball into position SV2 32 open, shown in FIG. 5, allowing the pump intake cycle to begin.

Figure 8:
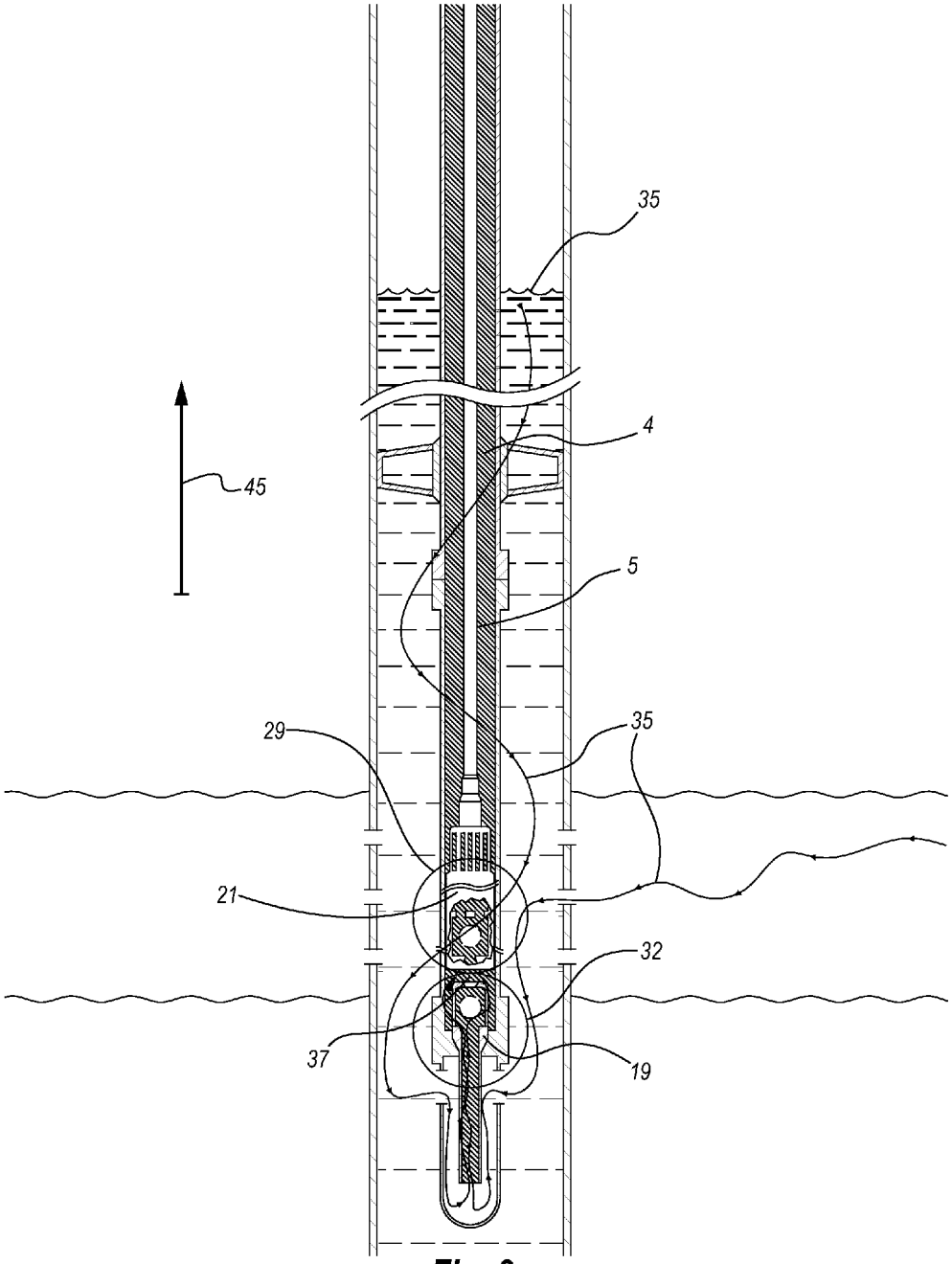

FIG. 8 illustrates the beginning of the intake portion of the pump cycle, after the initial upward motion of the traveling valve 21 being lifted by the rod string 5, lifting the fluid column 4. The traveling valve 21 creating a void 37 where the annulus fluid column plus reservoir liquid and gases 35 travel past the standing valve ball and seat shown in position SV2 32 open. The traveling valve 21 is shown in position TV1 29 closed and sealing and supporting the full weight of the fluid column 4 being lifted by the rod string 5. The rod string 5 is fully supporting the fluid column 4 weight, along with the weight of the rod string 5 along with the weight of the traveling valve 21 plus any resistance loads caused by friction minus the buoyancy effects of the rod string 5 within the fluid column 4.

Figure 9:
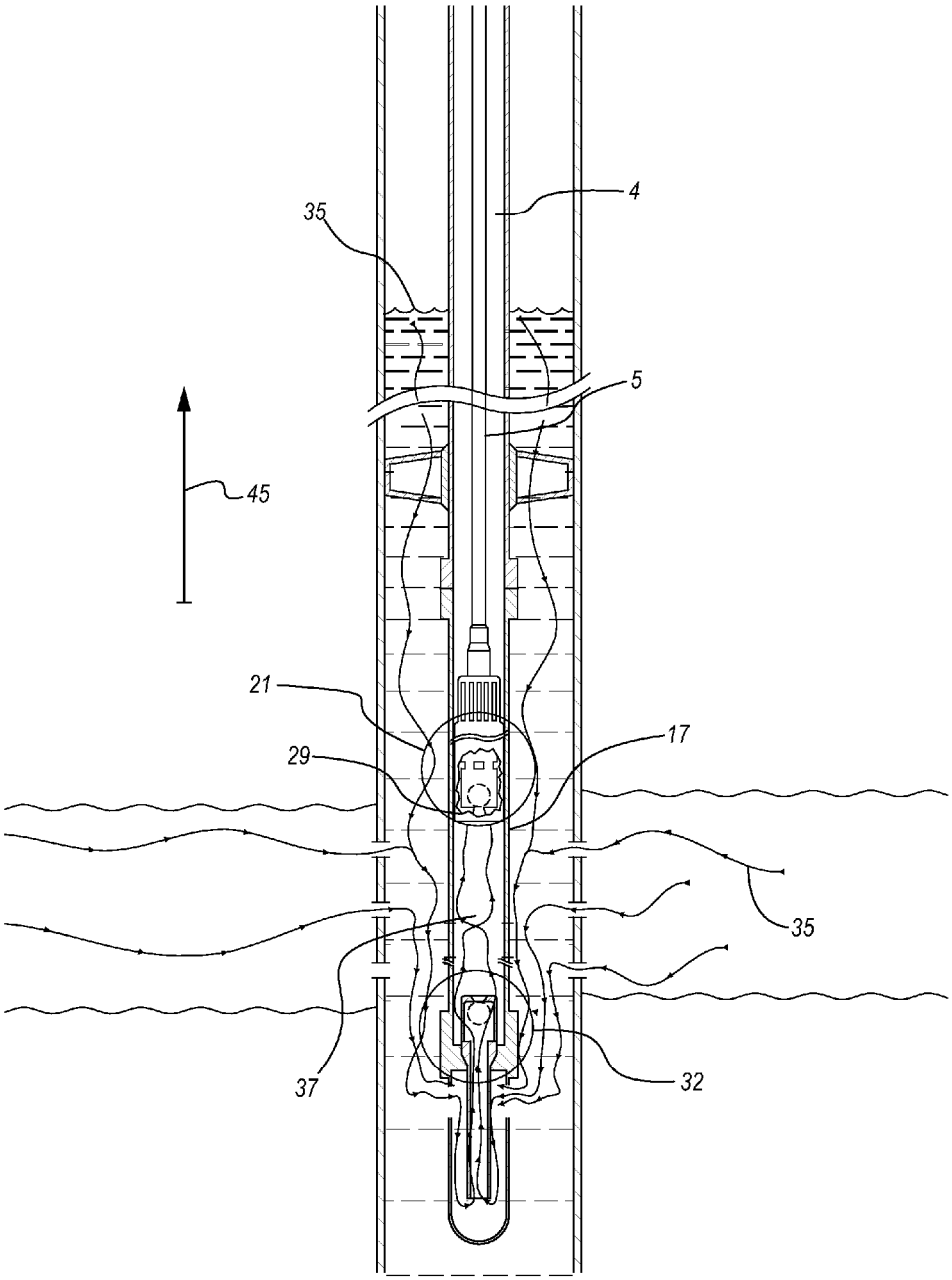

FIG. 9 further illustrates the intake portion of the pump cycle with additional upward motion 45 of the traveling valve 21 as being lifted by rod string 5 fully supporting the weight of the fluid column 4 sealed by the traveling valve shown in position TV1 29 closed. Any leakage past the traveling valve 21 allows the fluid column 4 being lifted by the rod string 5 to fall back down into the pump fillage void 37 being created within the working barrel 17. The working barrel 17 is being filled via annulus fluid column plus reservoir liquid and gases 35 traveling past the standing valve ball and seat shown in position SV2 32 open.

Figure 10:
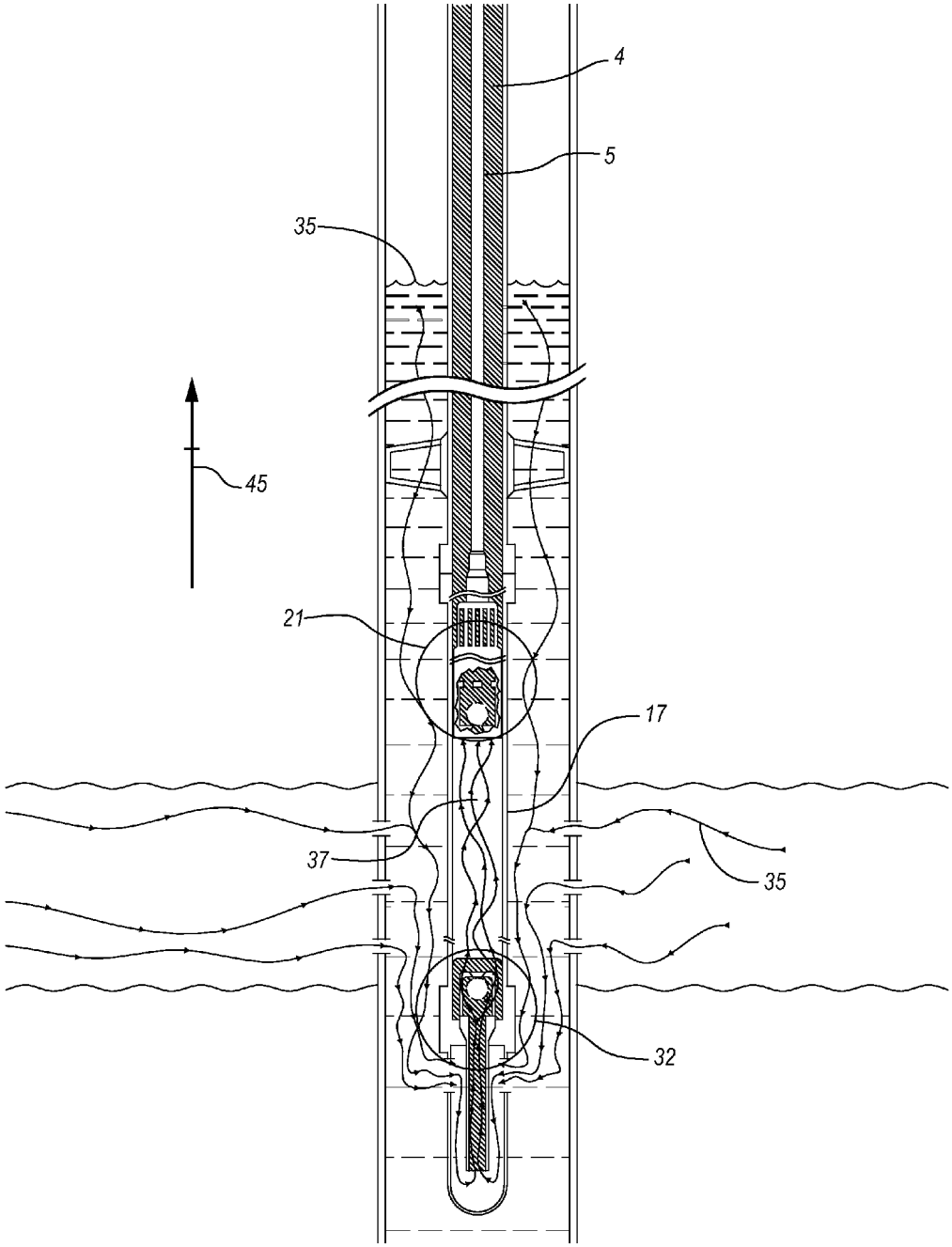

FIG. 10 illustrates the point at which the rod string 5 begins to decelerate during the pump intake portion of the cycle when the surface unit not shown decelerates the polished rod not shown. Rod string 5 begins to contract. Any leakage past the traveling valve 21 allows the fluid column 4 being lifted by the rod string 5 to fall back down into the pump fillage void 37 being created within the working barrel 17. The working barrel 17 is being filled via annulus fluid column plus reservoir liquid and gases 35 traveling past the standing valve ball and seat shown in position SV2 32 open.

Figure 11:
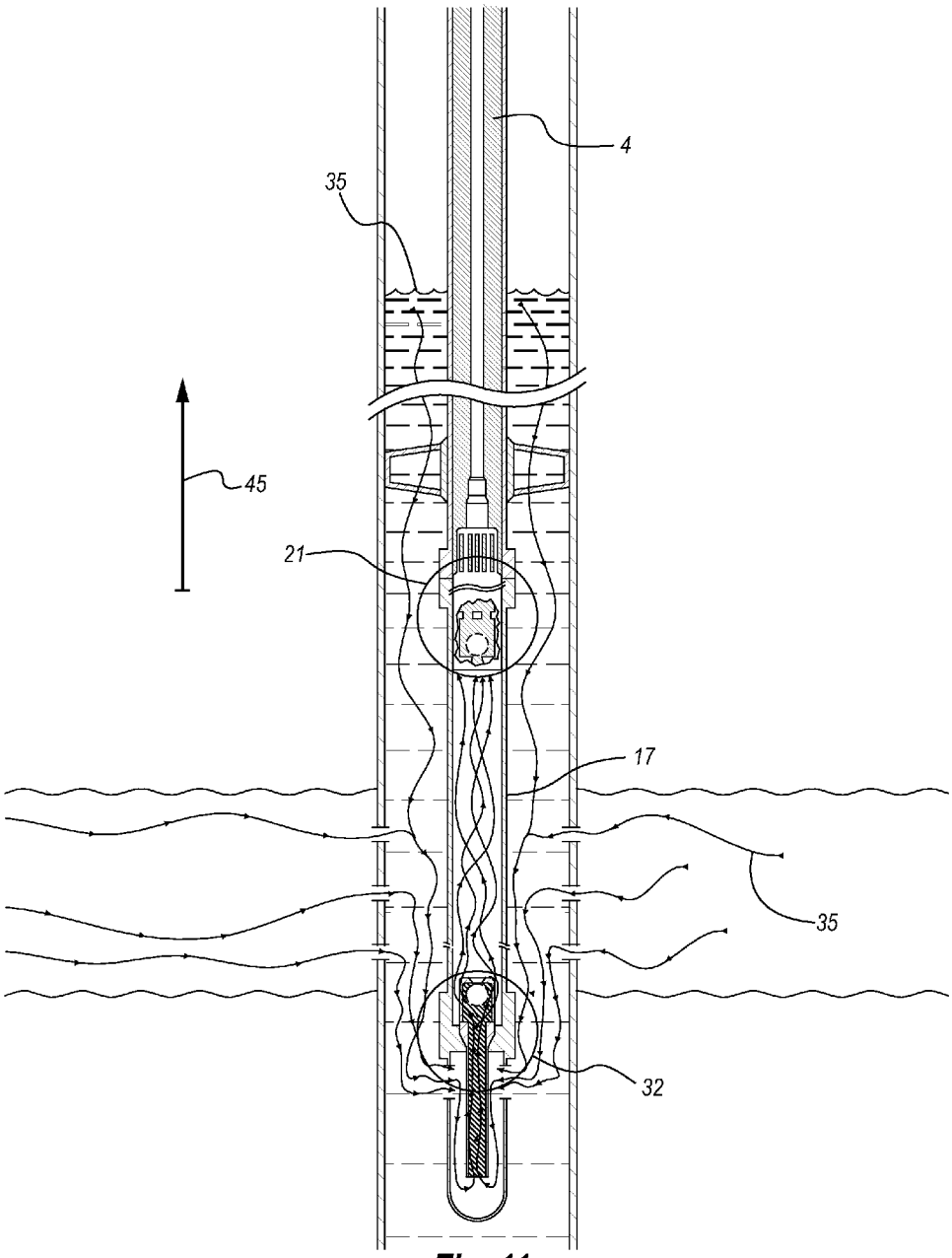

FIG. 11 illustrates the traveling valve 20 at the highest point of travel within the working barrel 5. FIG. 11 is a continuation of the pump intake cycle and items 10, 50 and SV2 are the same as shown in FIGS. 8 thru 10.

Figure 12:
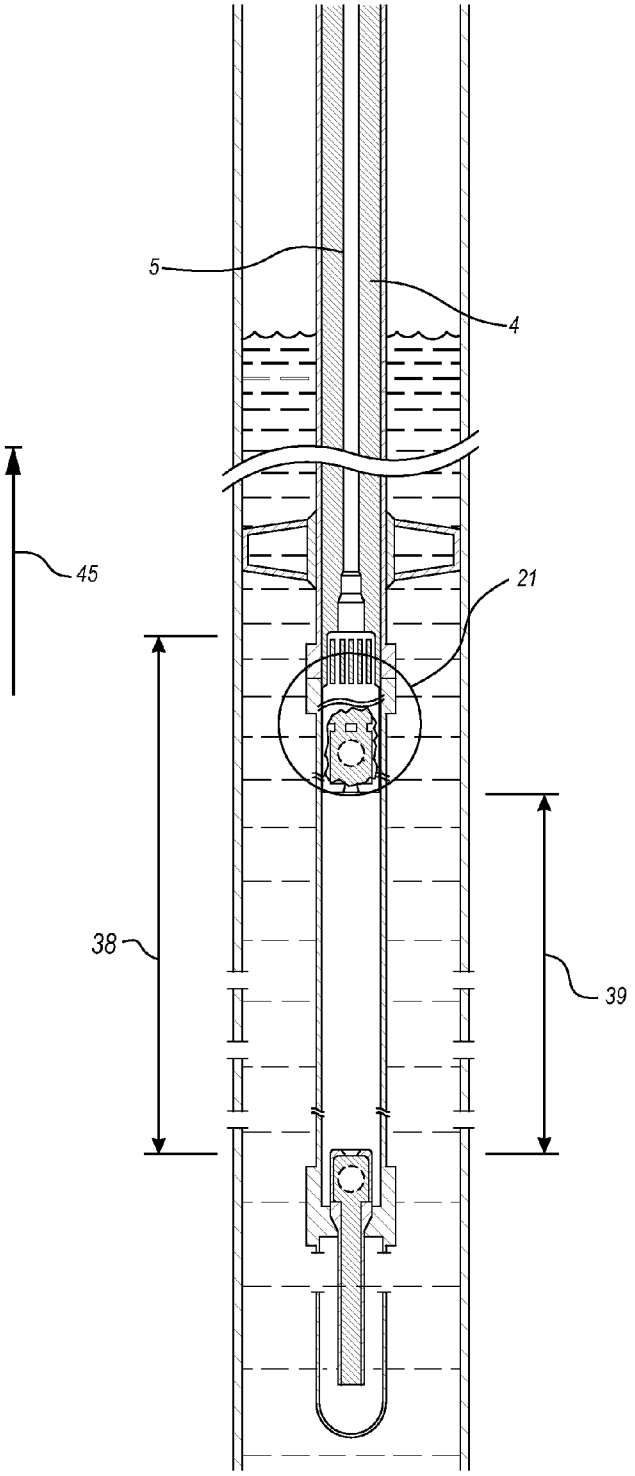
FIG. 12 Down-hole pump under travel

FIG. 12 illustrates down-hole pump under travel 45. The surface unit not shown has lifted the polished rod not shown travel 38 to the maximum allowed by the surface unit equipment. The difference in travel of the polished rod not shown versus the traveling valve 21 actual travel distance 39 is called under travel of the down-hole pump assembly and is caused by the rod string 5 stretching under the weight of itself plus the fluid column 4 weight. This ends the pump intake portion of the cycle.

FIG. 13 thru 17 individually represents the end of lifting travel for the traveling valve 21. These five figures all show varying pump fillage volumes of fluids versus gases versus a void created where nothing has filled the displaced volume within the working barrel. They are illustrated as 100%, 80%, 60%, 40% and 20% fluid fillage volumes. These are example fillage volumes and in actual use will vary between 100 and 0% fluid fillage volumes into the void 37 created within the working barrel 17 when the traveling valve 21 is lifted via the rod string 5 during the pump intake fillage portion of the total pump cycle. FIGS. 13 thru 17 are five different examples of the same portion of the pumping cycle, the inlet or working barrel fillage pump cycle portion.

Figure 13:
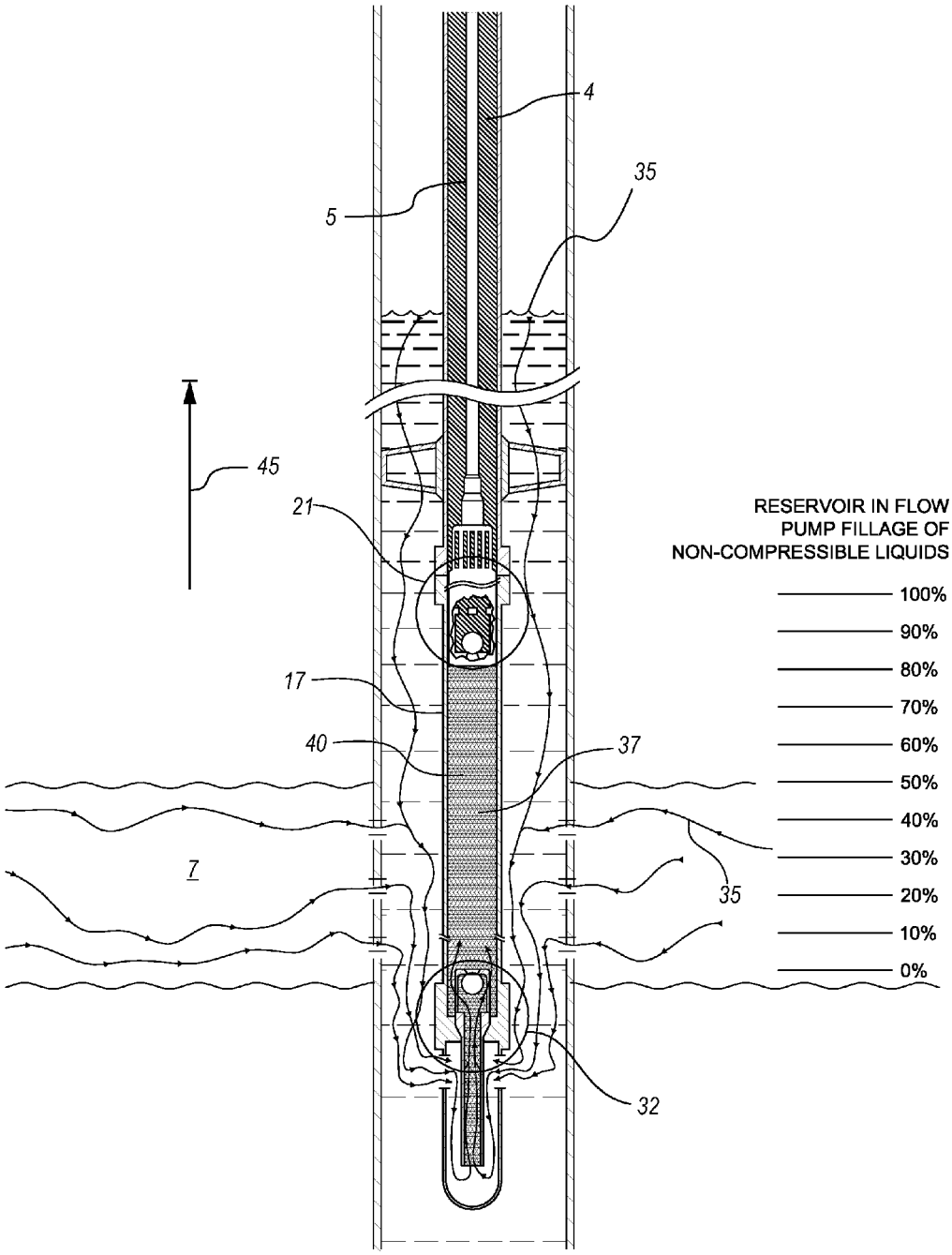
FIGS. 13-17 Working barrel fillage of liquids versus gaseous media

FIG. 13 illustrates the end of the pump intake portion of the total pumping cycle. The rod string 5 having lifted the fluid column plus traveling valve 21 to the highest position within the working barrel 17. During this lifting movement the void 37 created within the working barrel 17 is fully filled with fluid labeled as non-compressible fluid media 40. The working barrel 17 was filled via annulus fluid column plus reservoir liquids 35 traveling past the standing valve ball and seat shown in position SV2 32 open. This represents a perfect pump fillage; there is no gaseous media within the working barrel 17.

Figure 14:
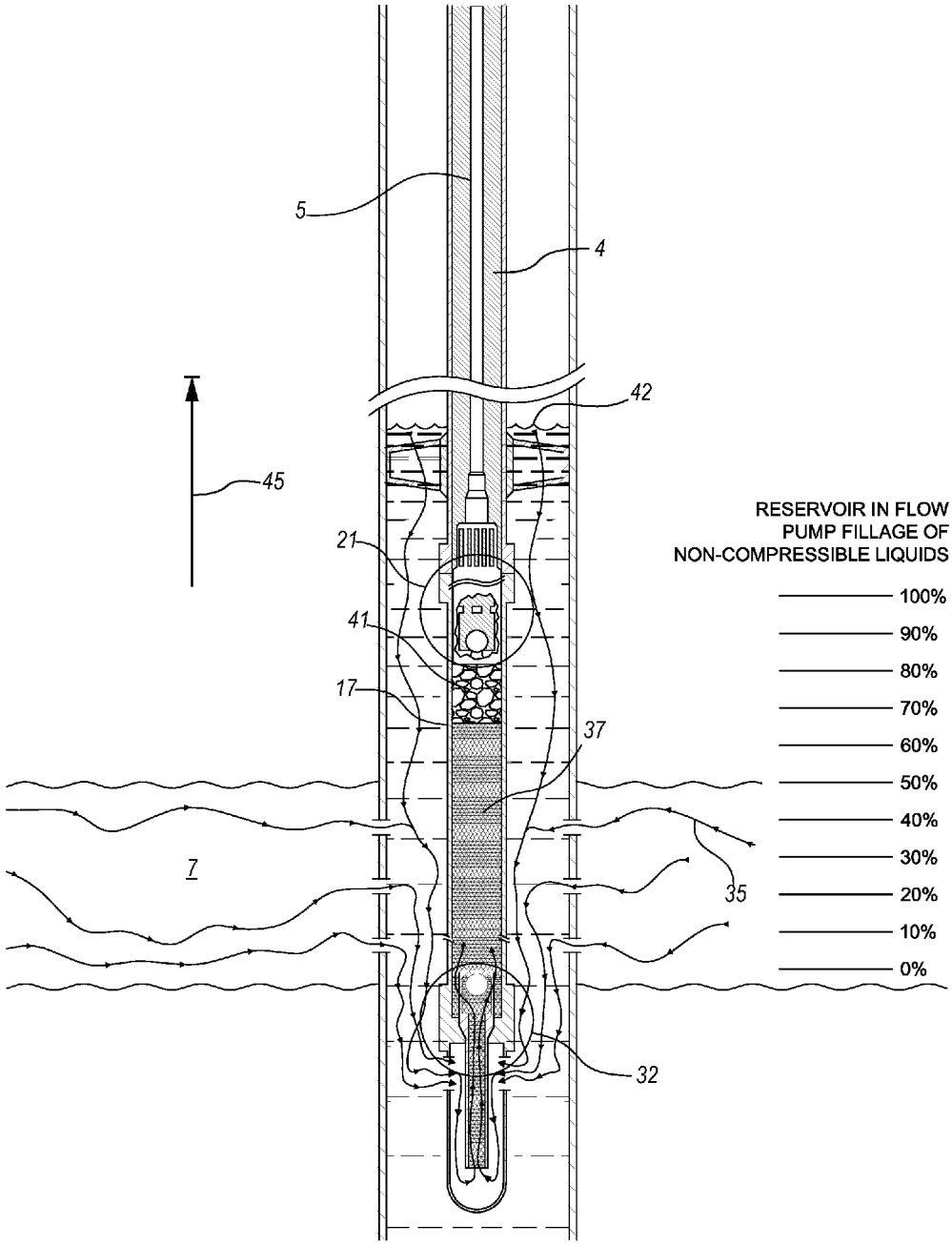

FIG. 14 illustrates the end of the pump intake portion of the total pumping cycle and shows a different working barrel fillage. The rod string 5 having lifted the fluid column 4 plus the traveling valve 21 to the highest position within the working barrel 17. During this lifting movement the void 37 created within the working barrel 17 is 80% filled with fluid labeled as non-compressible fluid media 40 and 20% filled with a compressible gaseous media 41. The working barrel 17 was filled via annulus fluid column 42 which is lower than FIG. 13 illustrated plus reservoir fluids and gases 35 traveling past the standing valve ball and seat shown in position SV2 32 open. Beings the annulus fluid column 42 is now lower in height versus FIG. 13 it is likely the reservoir liquid and gas rate of inflow has diminished versus what is shown in FIG. 13.

Figure 15:
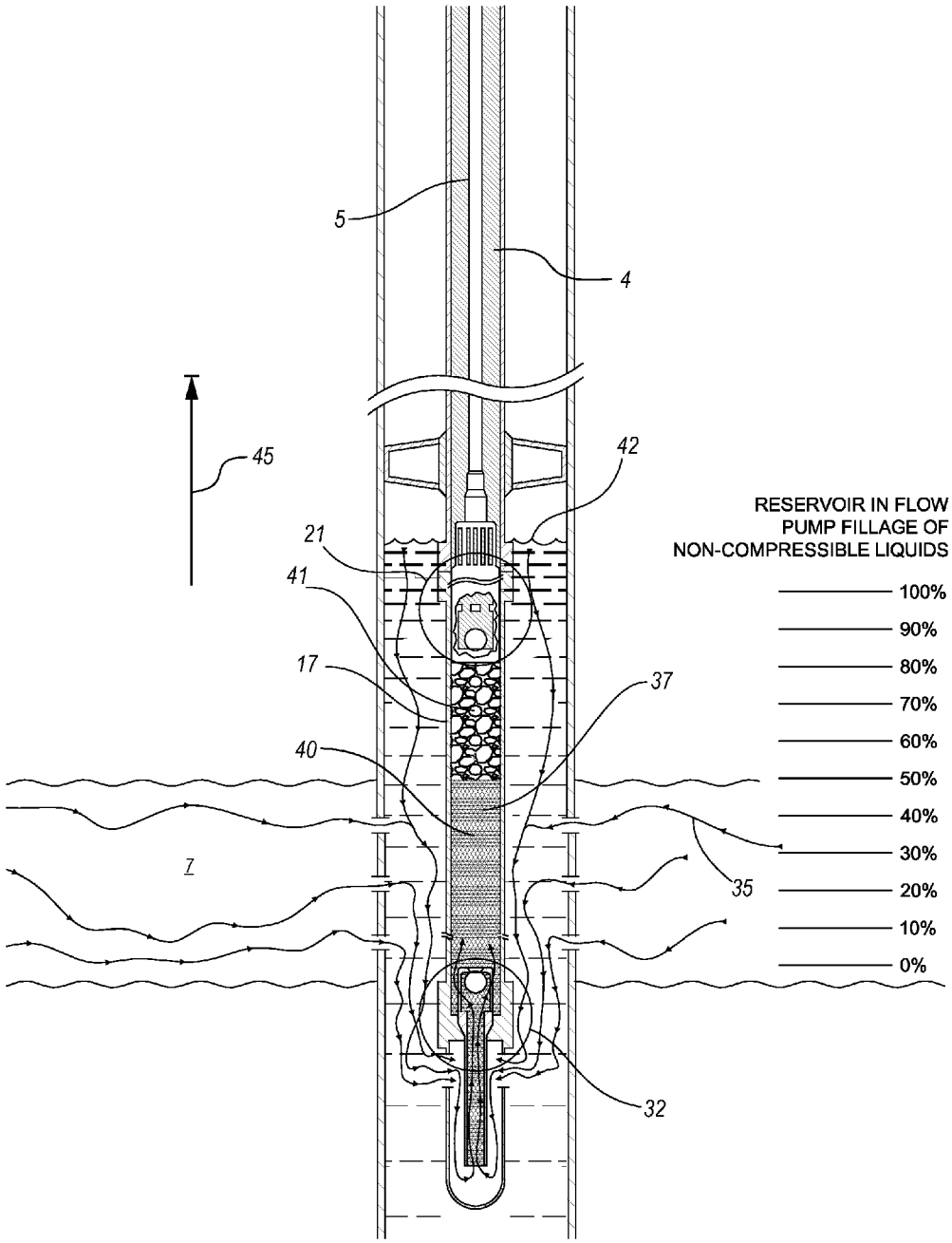

FIG. 15 illustrates the end of the pump intake portion of the total pumping cycle and shows a different working barrel fillage. The rod string 5 having lifted the fluid column plus the traveling valve 21 to the highest position within the working barrel 17. During this lifting movement the void 37 created within the working barrel 17 is 60% filled with fluid labeled as non-compressible fluid media 40 and 40% filled with a compressible gaseous media 41. The working barrel 17 was filled via annulus fluid column 42 which is lower than FIG. 14 illustrated plus reservoir liquids and gases 35 traveling past the standing valve ball and seat shown in position SV2 32 open. Beings the annulus fluid column 42 is now lower in height versus FIG. 14 it is likely the reservoir fluid and gas rate of inflow has diminished versus what is shown in FIG. 14.

Figure 16:
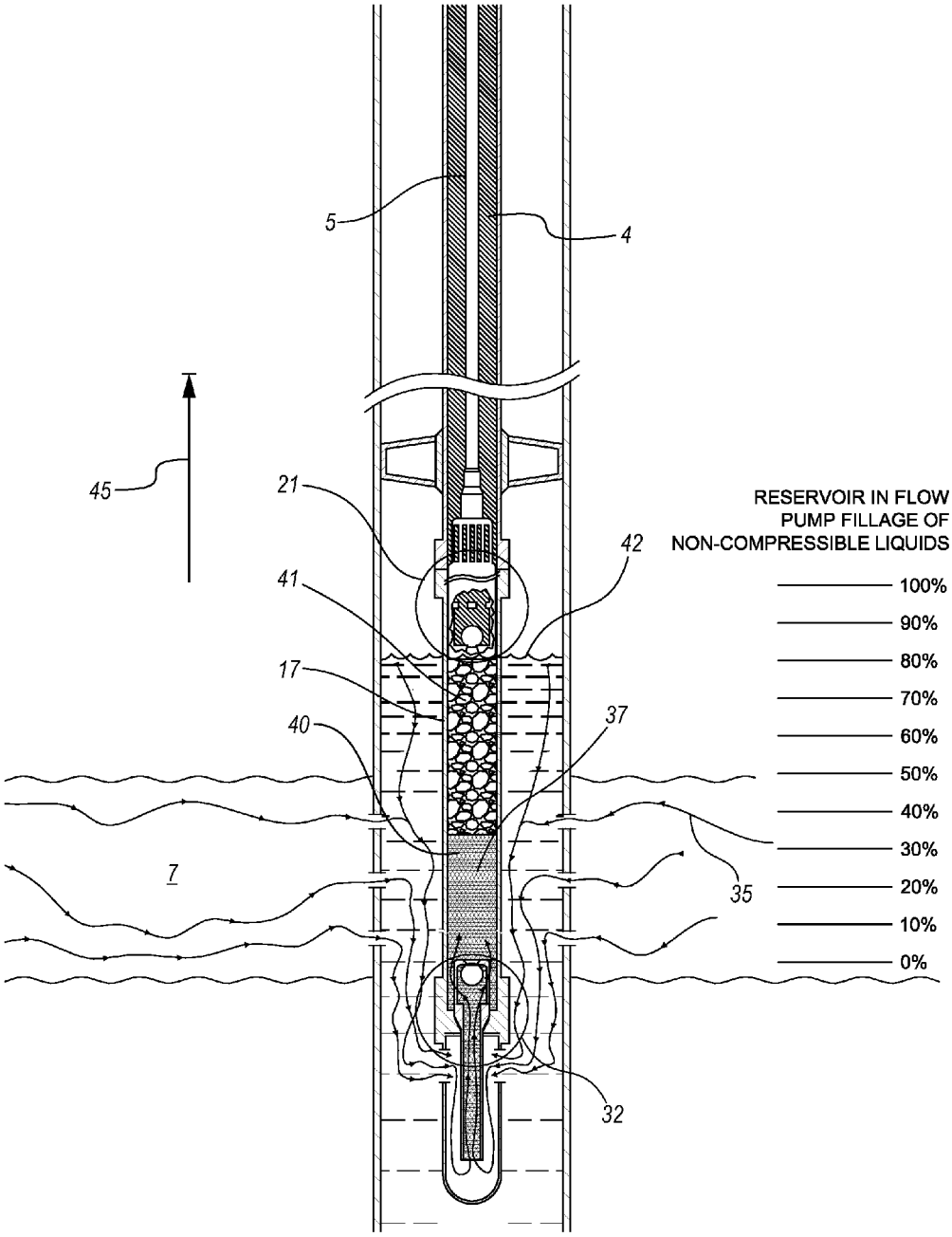

FIG. 16 illustrates the end of the pump intake portion of the total pumping cycle and shows a different working barrel fillage. The rod string 5 having lifted the fluid column plus the traveling valve 21 to the highest position within the working barrel 17. During this lifting movement the void 37 created within the working barrel 17 is 40% filled with fluid labeled as non-compressible fluid media 40 and 60% filled with a compressible gaseous media 41. The working barrel 17 was filled via annulus fluid column 42 which is lower than FIG. 15 illustrated plus reservoir fluids and gases 35 traveling past the standing valve ball and seat shown in position SV2 32 open. Beings the annulus fluid column 42 is now lower in height versus FIG. 15 it is likely the reservoir fluid and gas rate of inflow has diminished versus what is shown in FIG. 15.

Figure 17:
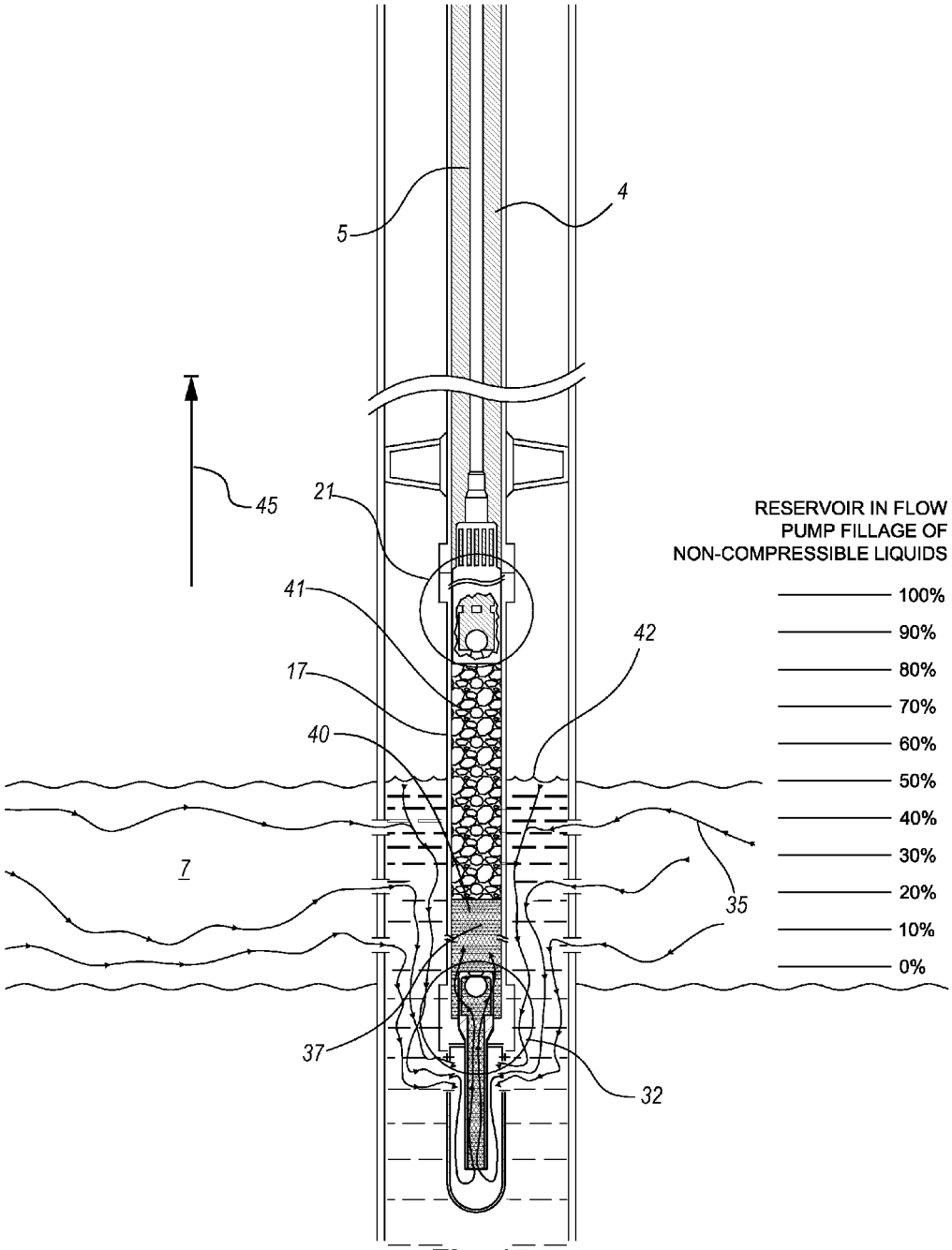

FIG. 17 illustrates the end of the pump intake portion of the total pumping cycle and shows a different working barrel fillage. The rod string 5 having lifted the fluid column plus the traveling valve 21 to the highest position within the working barrel 17. During this lifting movement the void 37 created within the working barrel 17 is 20% filled with fluid labeled as non-compressible fluid media 40 and 80% filled with a compressible gaseous media 41. The working barrel 17 was filled via annulus fluid column 42 which is lower than FIG. 16 illustrated plus reservoir fluids and gases 35 traveling past the standing valve ball and seat shown in position SV2 32 open. Beings the annulus fluid column 42 is now lower in height versus FIG. 16 it is likely the reservoir fluid and gas rate of inflow has diminished versus what is shown in FIG. 16.

Figure 18:
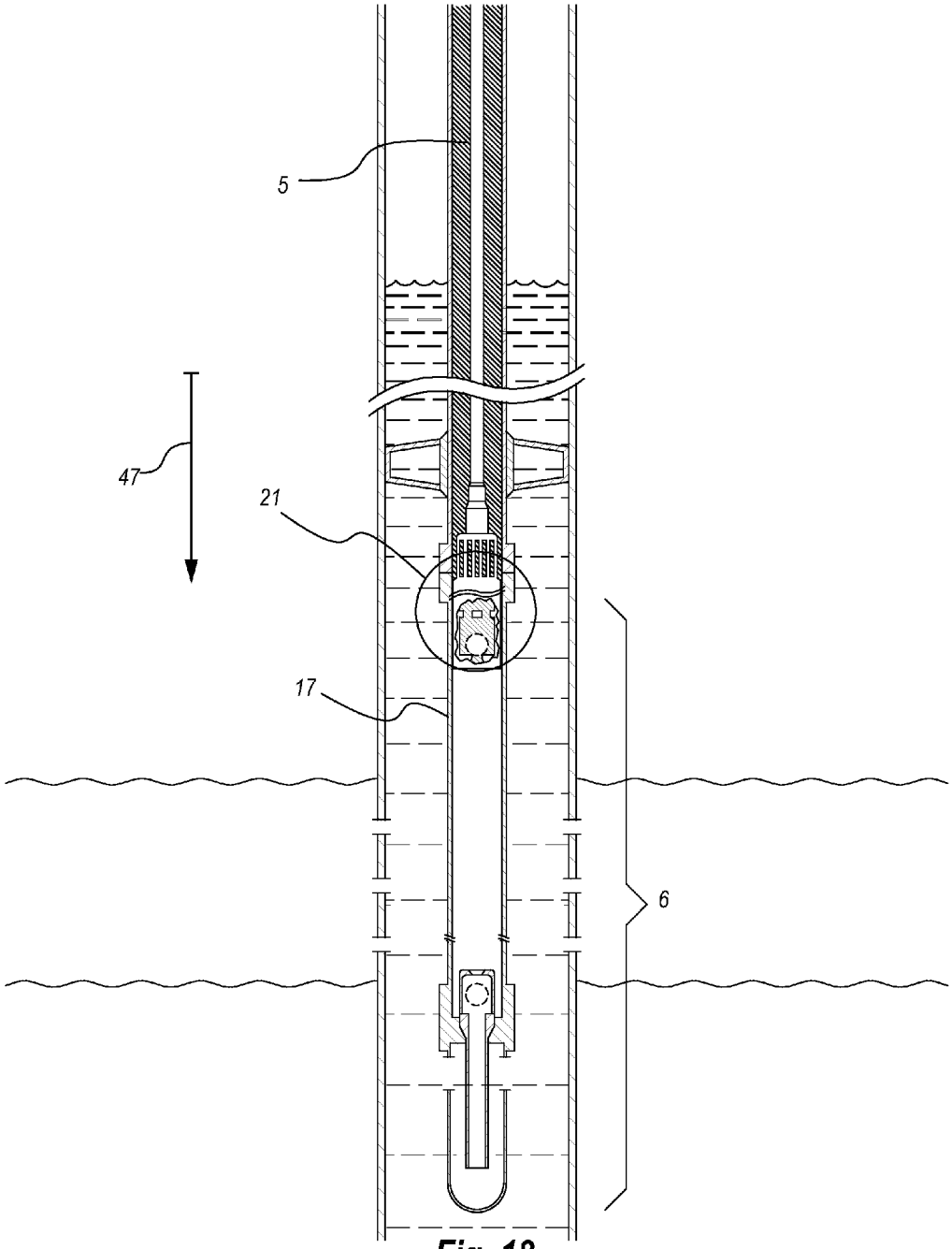
FIG. 18 Pressurization of working barrel trapped media

FIG. 18 illustrates the down-hole pump assembly 6 at the top of the polished rod total travel not shown, the rod string 5 having fully lifted traveling valve 21 within the working barrel 17 with 100% fluid fillage of the down-hole pump 6. The surface unit not shown begins lowering the polished rod not shown. The rod string 5 begins to compress top to bottom, once motion is realized at the traveling valve 21 the trapped fillage volume begins to pressurize forcing the standing valve ball and seat to transition into position SV1 31 but it is not there yet.

Figure 19:
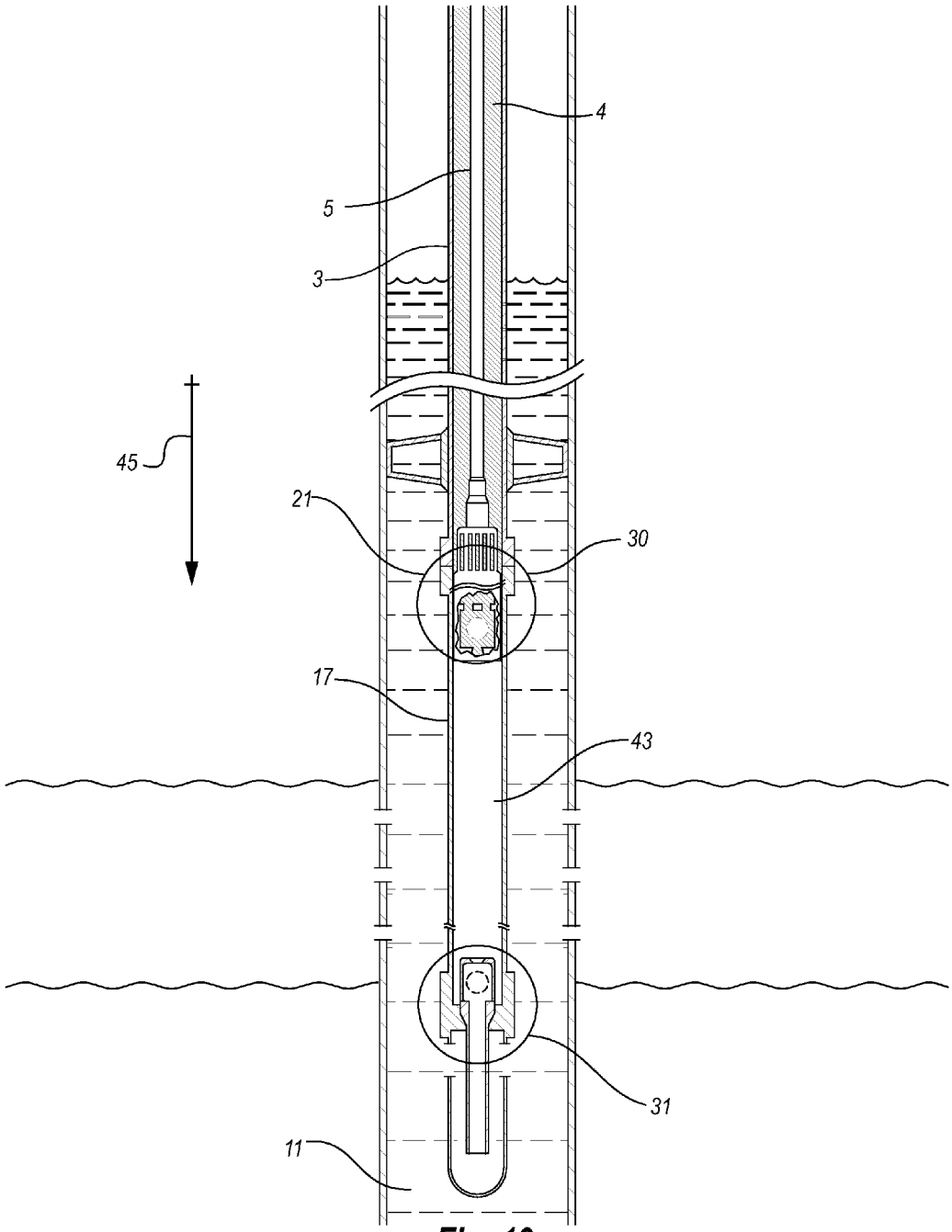
FIG. 19 Weight transfer position

FIG. 19 illustrates the rod string 5 transferring downward motion to the traveling valve 21. The trapped fillage volume 43, shown as 100% fluid fillage, under the traveling valve 21, now moving downward 47, further pressurizes volume 43, forcing the standing valve ball and seat into position SV1 31 closed, which in turn blocks and seals the pathway to annulus volume 11. Once the pressurized fluid volume trapped within working barrel 17 exceeds the pressure, hence force exerted at the bottom of fluid column 4, acting to close the traveling valve ball 23 and seat 22, the ball is forced off its seat into traveling valve position TV2 30 open. Trapped fluid volume 43 now is able to communicate with fluid column 4. It is at this position as measured within polished rod not shown total travel where weight transfer position (WTP) occurs. The weight exerted of fluid column 4 is now fully supported by the production tubing string 3 and the standing valve shown in position SV1 31 closed. Rod string 5 weight is reduced by the same amount of weight as the fluid column 4 minus any frictional and buoyancy forces. Rod string 5 weight is measured by the surface unit not shown by measuring and recording the weight hanging below the polished rod not shown. Polished rod not shown position is measured and recorded by the surface unit not shown.

Figure 20:
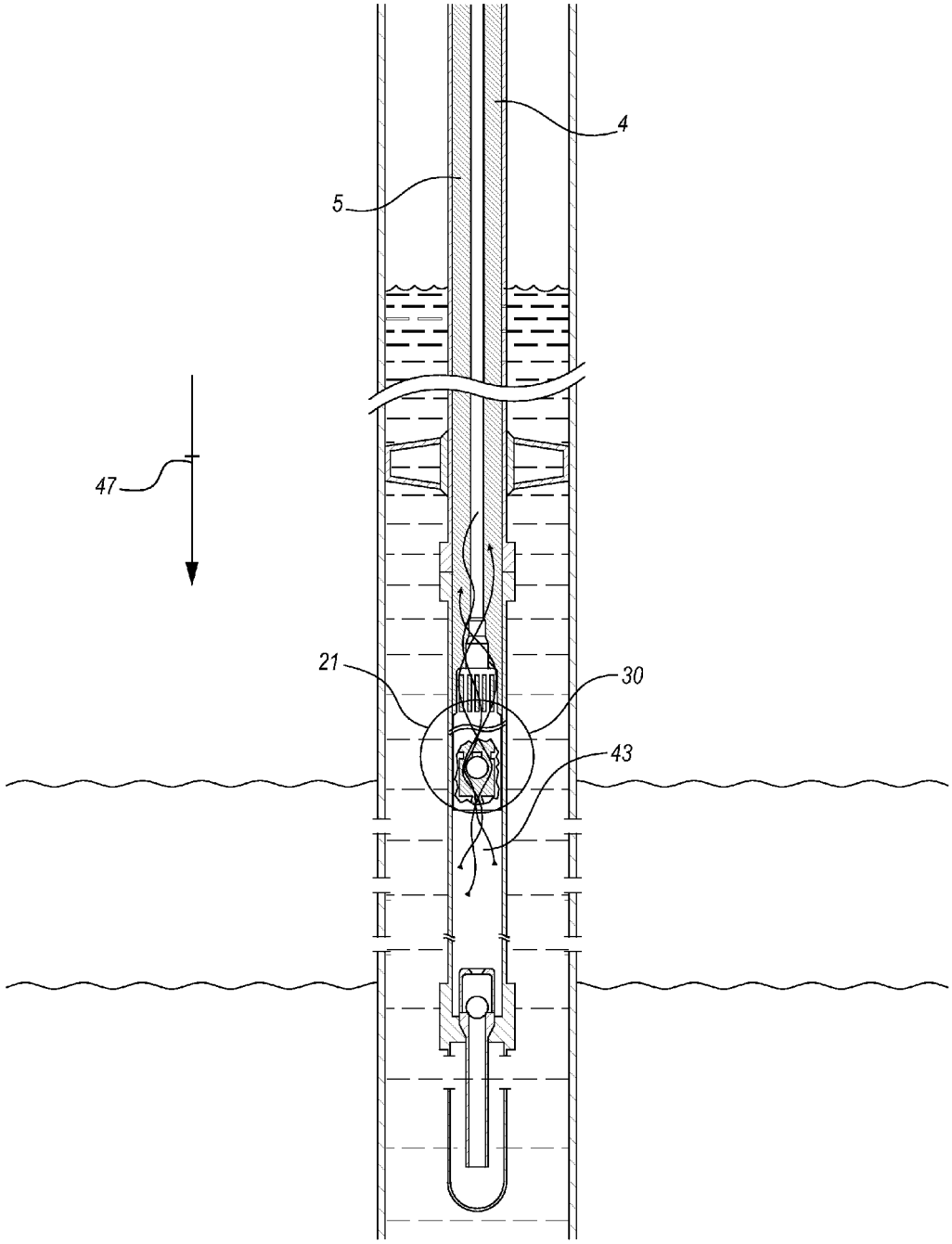
FIGS. 20-22 Adding working barrel fluids to fluid column

FIG. 20 illustrates the continuing downward motion 47 of the rod string 5, the traveling valve 21 shown in position TV2 30 open allowing the trapped fluid fillage 43 into the bottom of fluid column 4.

Figure 21:
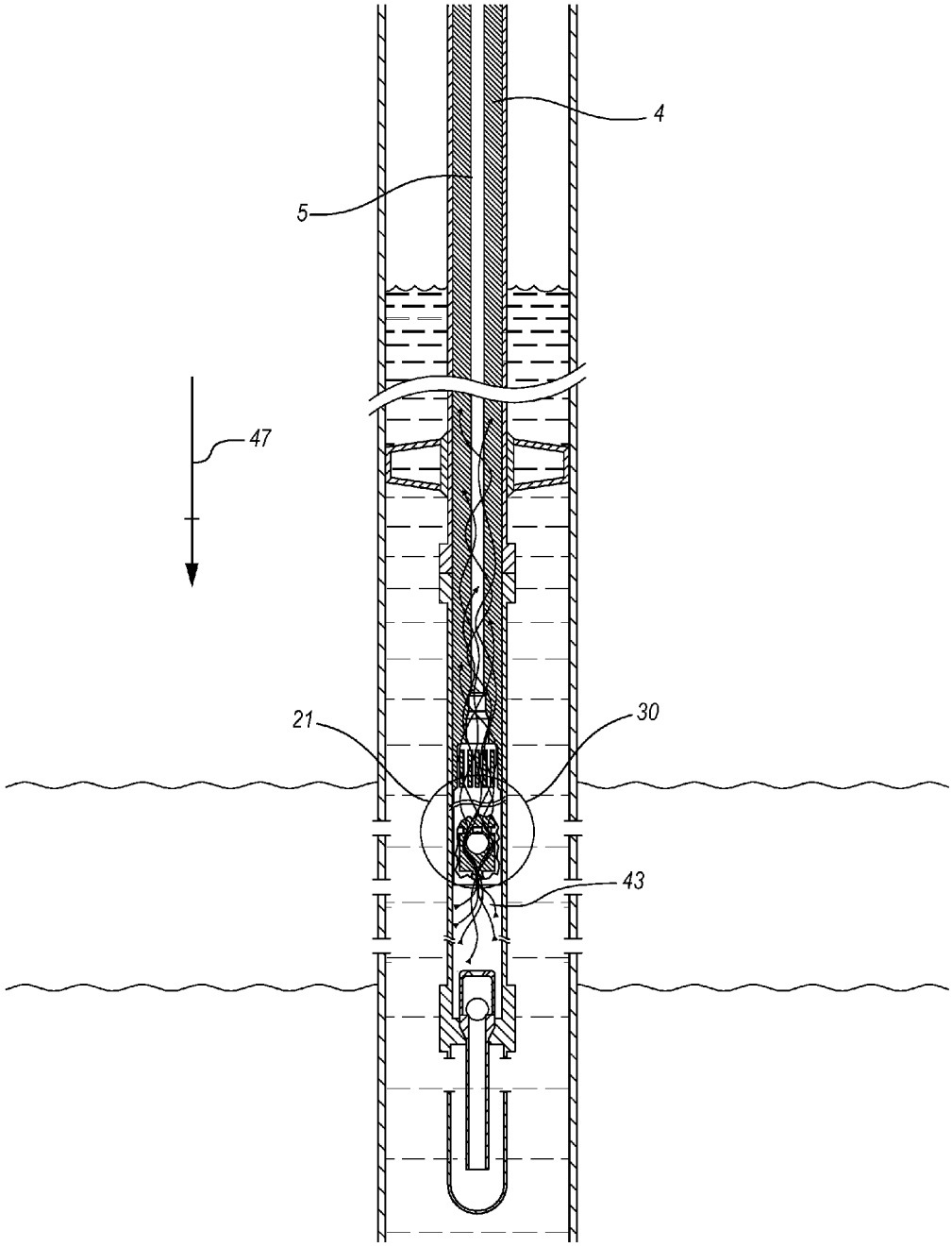

FIG. 21 illustrates the continuing downward motion 47 of the rod string 5, the traveling valve 21 shown in position TV2 30 open allowing the trapped fluid fillage 43 into the bottom of fluid column 4. The polished rod not shown reaches the deceleration position and the surface unit not shown begins to slow the velocity of downward travel of the rod string 5. The rod string 5 begins to stretch under the weight of itself from top to bottom.

Figure 22:
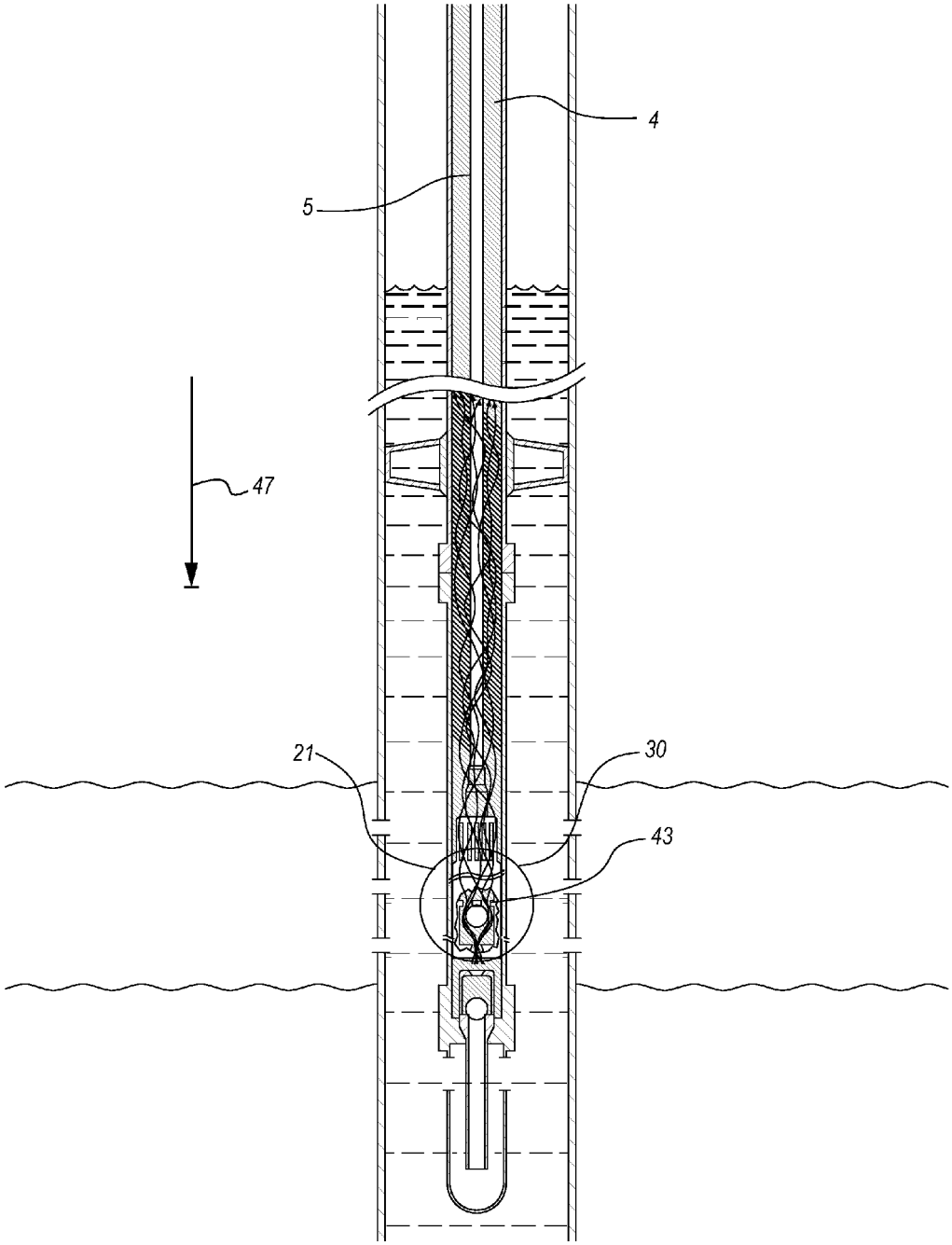

FIG. 22 illustrates the fully lowered rod string 5 and traveling valve 21 shown in position TV2 30 open. Motion of the traveling valve is reduced to the elastic up and down bouncing cycles of the rod string 5 since the polished rod not shown has ceased downward motion. This is the end of downward motion 47 and the end of the pressurization cycle and the end fluid column 4 adding of newly trapped fluid volume 43 cycle. The pumping cycle repeats as shown in FIG. 6.

Figure 23:
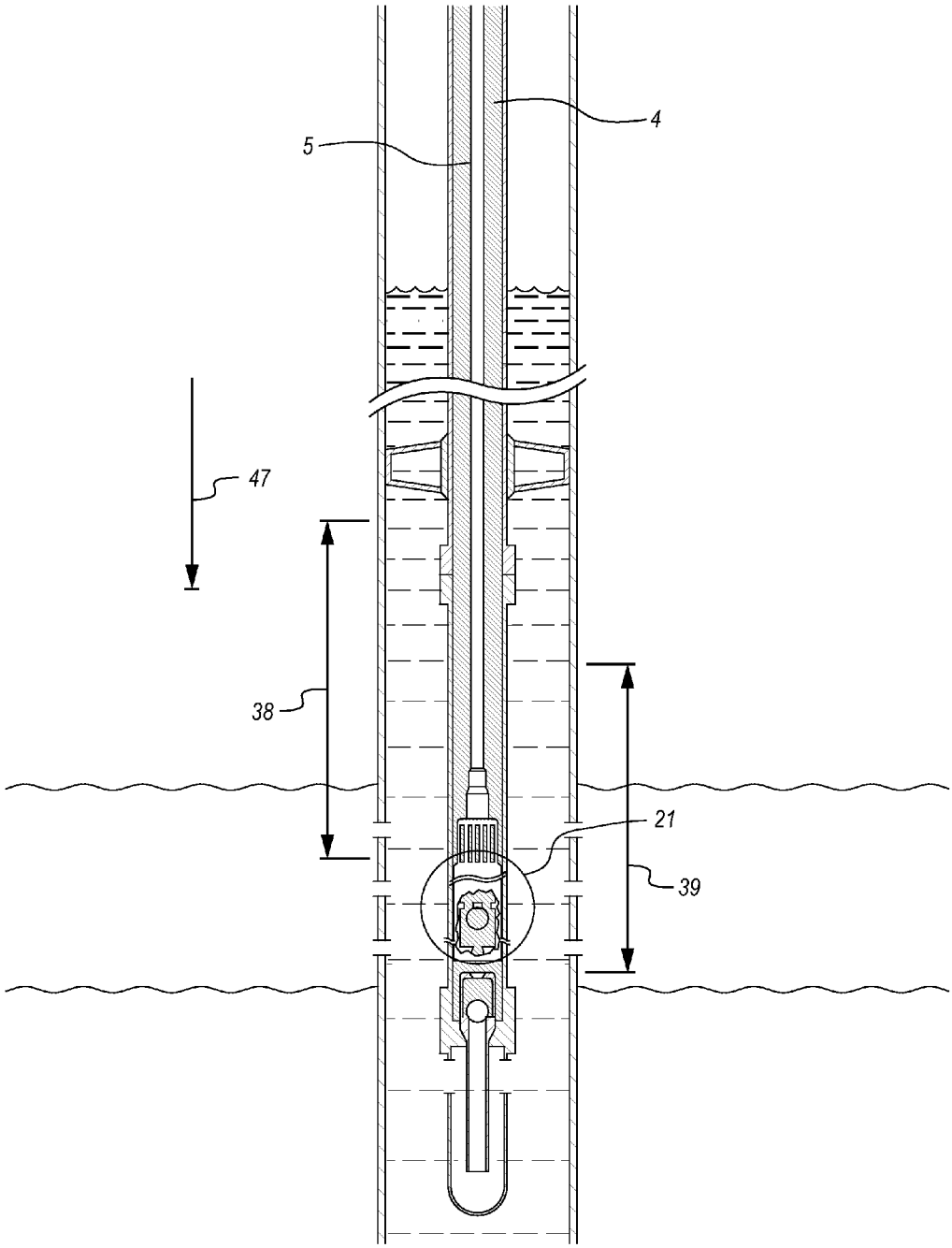
FIG. 23 Down-hole pump over travel

FIG. 23 illustrates down-hole pump over travel. The surface unit not shown has lowered the polished rod not shown to the maximum allowed 38 by the surface unit equipment. The difference in travel of the polished rod not shown versus the traveling valve 21 actual travel distance 39 is called over travel of the down-hole pump assembly and is caused by the rod string 5 stretching under the weight plus inertia of itself. This ends the high pressure positive displacement pumping cycle.

Figure 24:
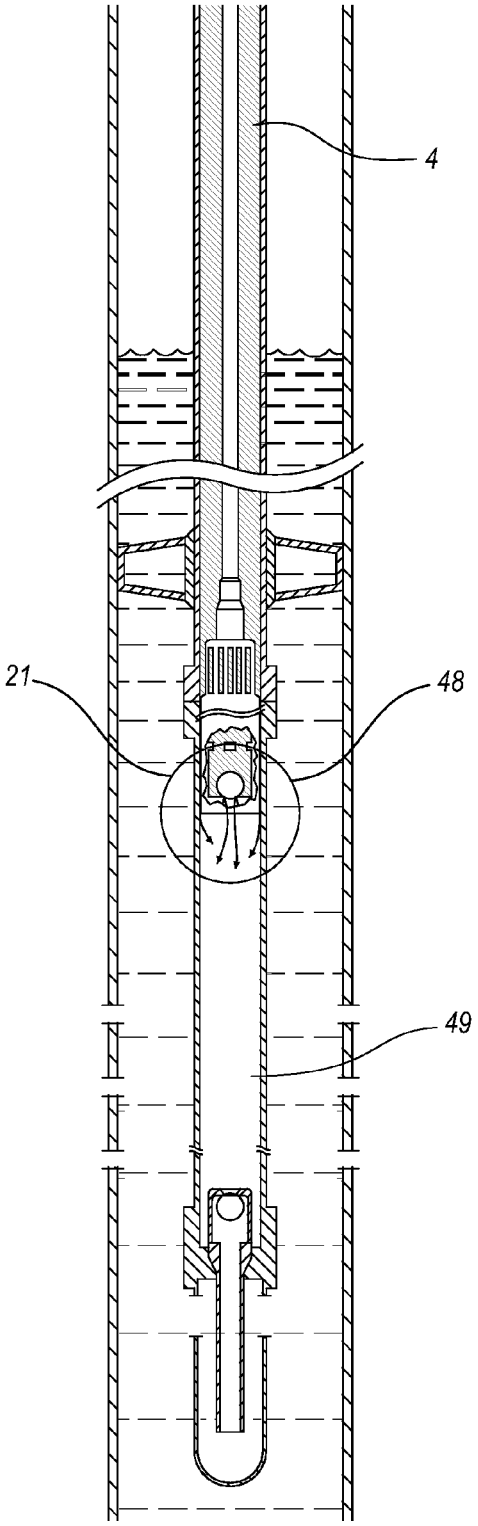
FIG. 24 Traveling valve leakage

FIG. 24 illustrates traveling valve leakage 48. Leakage also called slippage has two paths one is past the ball and seat and the other is past the OD versus ID of the plunger and working barrel. The pressure generated from the height of the fluid column 4 is at a higher pressure level than the inside of the working barrel 49, hence pressure differential. The traveling valve 21 is between the high and low pressure levels 4 and 49 respectively. The weight of the fluid column is measured at the surface unit via the polished rod both not shown. As the fluid column leaks 48 past the traveling valve 21 the weight change plus rate of weight change is detected, measured, and recorded at the surface unit over a given time amount that the polished rod is held stationary against gravity during the lifting portion of the pump cycle. The amount of weight decrease plus rate of change for said weight decrease off the polished rod not shown is indicative of traveling valve leakage also called slippage factor.

Figure 25:
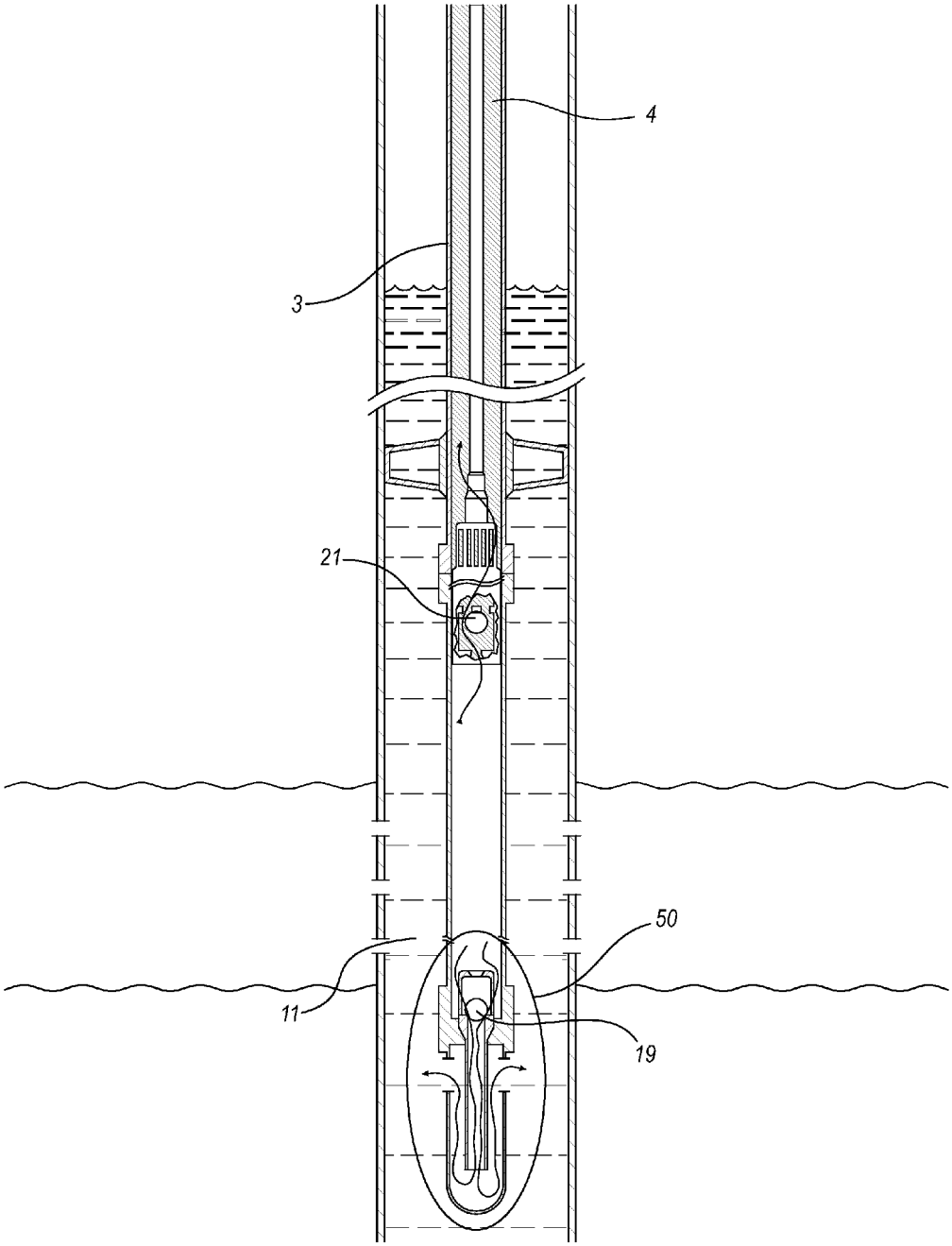
FIG. 25 Standing valve leakage

FIG. 25 illustrates the standing valve leakage pathway 50. Leakage also called slippage is past the ball and seat of the standing valve 19. After weight transfer occurs; the tubing string 3 along with the standing valve 19 now fully support the fluid column 4 within the pump. The pressure generated from the height of the fluid column 4 is at a higher pressure level than the annulus 11. The closed standing valve 19 is between the high and low pressure levels. As the fluid column 4 leaks past the standing valve 19; the fluid column displacement past the open traveling valve 21 tends to close the traveling valve again. The amount of weight increase plus rate of change for said weight increase back to the polished rod not shown is indicative of standing valve leakage or slippage factor. The polished rod weight load plus rate of change is detected, measured, and recorded at the surface unit over a given time amount that the polished rod is held stationary against gravity during the lowering portion and after weight transfer position has occurred during the pump cycle while testing the standing valve.

Figure 26:
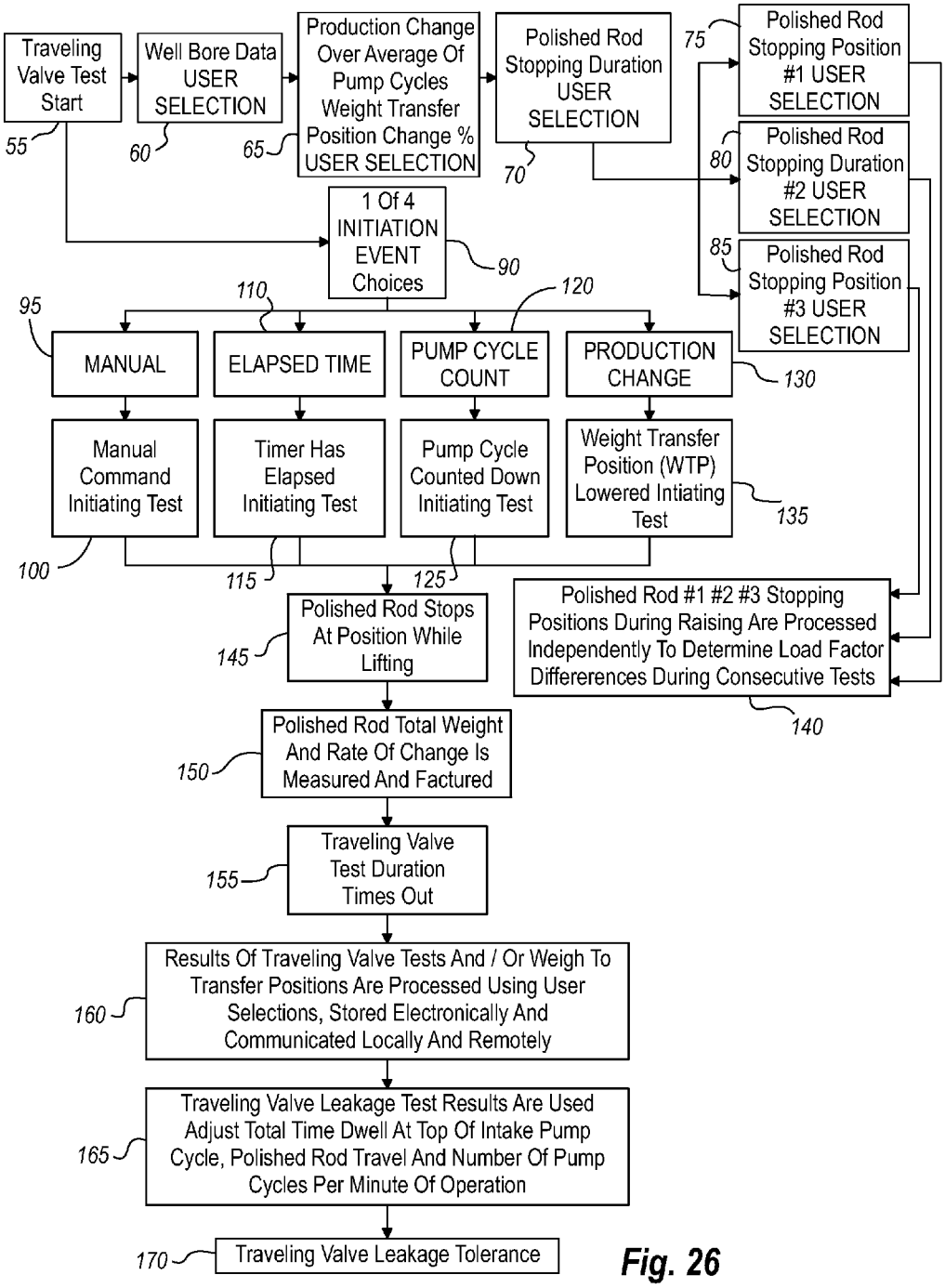
FIG. 26 Traveling valve test method flow diagram

FIG. 26 illustrates the method process flow diagram for testing and detecting traveling valve leakage autonomously by the surface unit, also called slippage factor of the traveling valve 55. The flow chart illustrates using well bore diagram information 60, these are user inputs that include yet not limited to the ones listed herein for polished rod travel, pump setting depth, pump bore size, pump running clearance, pump stroke length, API pump style, fluid type, API grade (specific gravity) of fluid pumped, water cut percentage and whether it is a gas or oil well. The traveling valve test process does not require this information but is helpful when detailing and illustrating the test results. The test results are a determination of the polished rod weight minimum and maximum plus rate of weight change over time allotted 70 while the polished rod is held stationary by the surface unit. This combined value is the leakage factor also called slippage factor. Surface unit motion control of the polished rod dynamics utilizes this leakage factor for subsequent calculations in determining how best to power and control the down-hole pump to optimize production 165.

Weight transfer position falling percentage of total polished rod travel 65, is a user entered value which is the lowest weight transfer position the operating company wishes the surface unit to continue pumping at. This value for preferred embodiment may be user selectable between 1-50% of total polished rod travel. Upon falling below this value for an average number of pump cycles which, for the preferred embodiment may be user selectable from 1-100 pump cycles; the surface unit shuts off and dispatches remote communication along with local display why the surface unit shut off Traveling valve testing time duration 70 for certain preferred embodiments may be user selectable entered in seconds from 1-100 seconds. It is the time the polished rod, during the lifting pump cycle, is autonomously held stationary against gravity. Polished rod stopping positions 75, 80, 85 are percentage values based off polished rod total travel which is set electronically at time of initial surface unit commissioning. These stopping positions for certain preferred embodiments may be user selectable from 1-100% and typically are spread out over the total travel distance of the working barrel taking over and under travel into account which is mechanically accounted for at time of pump setting and verified during initial surface unit commissioning on location.

The stopping positions for all subsequent autonomous traveling valve slippage tests cycle thru the three distinct polished rod travel percentage positions 75, 80, 85 in order and repeated in order during subsequent tests. Traveling valve test results of all three independent stopping positions 75, 80, 85 are available individually logged with time, date and pump cycle count as well as an averaged sample of all three stopping positions logged with 3 times, 3 dates and 3 pump cycle counts listed as they occurred. By having at least three distinct stopping positions 140 a clearer view of the working barrel condition is assessed versus stopping in same position or randomly on each subsequent traveling valve slippage test.

Traveling valve test initiation is triggered off of four possible scenarios 90. They each are identified as 95, 110, 120, and 130. When triggered the traveling valve test method is performed on the following pump cycle. Manual triggering 95; could be local at the well site 100 or remote off the well site triggered by remote communication protocols. Elapsed time triggering 110 in hours since previous test occurred. This time value 115 is user preselected and fully adjustable between 1-999 hours. Total number of pumping cycles having occurred 120 since previous test. Pumping cycle quantities 75 are user preselected and may be fully adjustable between 1-999,999 pump cycles.

Production change 130, represents a user preselected and fully adjustable percentage value 135 which for certain preferred embodiments may range between 1-99% of detected falling weight transfer position. This value can be from the previous pump cycle or an average of previous pump cycles which for certain preferred embodiments may also be user adjustable from 1-99 pump cycles. This falling weight transfer position percentage value would be greater than the value set in box 70. The falling weight transfer position 135 is based from total polished rod travel as commanded and measured by the surface unit. The value is expressed in polished rod percentage of working barrel fillage of nearly non-compressible fluids. When this preset value has surpassed below the selected setting, it could indicate severe well damage and hence be an early warning indicator in preventing additional damages down-hole. Upon reaching this lowering weight transfer position from previous pumping cycle or average of pumping cycles an alert communication is dispatched via external communication protocols as a warning to the supervisory position remotely off-site and displayed locally on the surface unit.

Upon initiation of testing process 55 as determined by process 90, the surface unit utilizes all user preselected test variables in performing autonomous traveling valve test. After testing process has finished it resets the initiation process, resumes pumping and waits next triggering of 95, 110, 120 or 130. Upon next triggering the surface unit remembers what position 75, 80 or 85 the polished rod was stopped at on last test, then during the next lifting portion of the pump cycle, proceeds to decelerate and stop the polished rod in a controlled manner 145, holding the polished rod stationary against gravity at the next user preselected position 140. Polished rod weight is measured initially upon stopping and continually monitored, factored and recorded 150 over stopping time duration 70. Upon time elapse of 155 a maximum and minimum polished rod weight is known plus rate of decay over time is determined or factored, which includes electronically recording for all future uses. This determined value is the leakage factor also called slippage factor of the traveling valve assembly.

Traveling valve slippage factor and WTP of previous pump cycle to this test pump cycle are both output; as a value and communicated locally plus transmitted via remote communication protocols 160. The surface unit runs until shut off either locally or remotely based upon a human decision to continue pumping or stop pumping based on traveling valve leakage exceeding user preselected value 170 or lowering WTP below the preselected value of box 65. Traveling valve leakage value 165 is used to limit time dwell at the top of the pump intake cycle of the surface unit when engaged. This value 165 is used to limit minimum polished rod total travel of the surface unit when engaged. This value 165 is used to limit the minimum pump cycles per minute frequency of the surface unit when engaged. All three above values 165 are further detailed in FIG. 28.

Traveling valve slippage factor represents a given volume of fluid that is leaking past the traveling valve and production tubing during normal pumping operation. This value of traveling valve and possibly production tubing slippage could hinder daily production and increase cost of operating beyond an acceptable tolerance range of the operating company. Hence for certain preferred embodiments, a user selectable and adjustable slippage factor tolerance amount may vary between 1 and 1000 is used as indicated in box 170. 1 represents a very low leakage rate, 1000 represents a very large leakage rate. The tolerance value is devised from the well bore diagram information along with actual known down-hole operating conditions of the well and reservoir formation plus human intuition of expected production rates at time of initial commissioning. All user pre-selections are available for modifications any time with proper password identification entered locally or remotely.

When the traveling valve leakage is excessive; time dwell at top of intake cycle, minimum polished rod travel distance and minimum pump cycles per minute all directly impact 165 daily production and daily cost of operating the specific well. By offering a slippage factor tolerance 170 pre-selectable between 1-1000 one is capable of tailoring the surface unit polished rod motion control to allow for differing well bore diagram operational installations and actual down-hole operating conditions. The slippage tolerance value 1-1000; is the acceptable leakage for the traveling valve.

Figure 27:
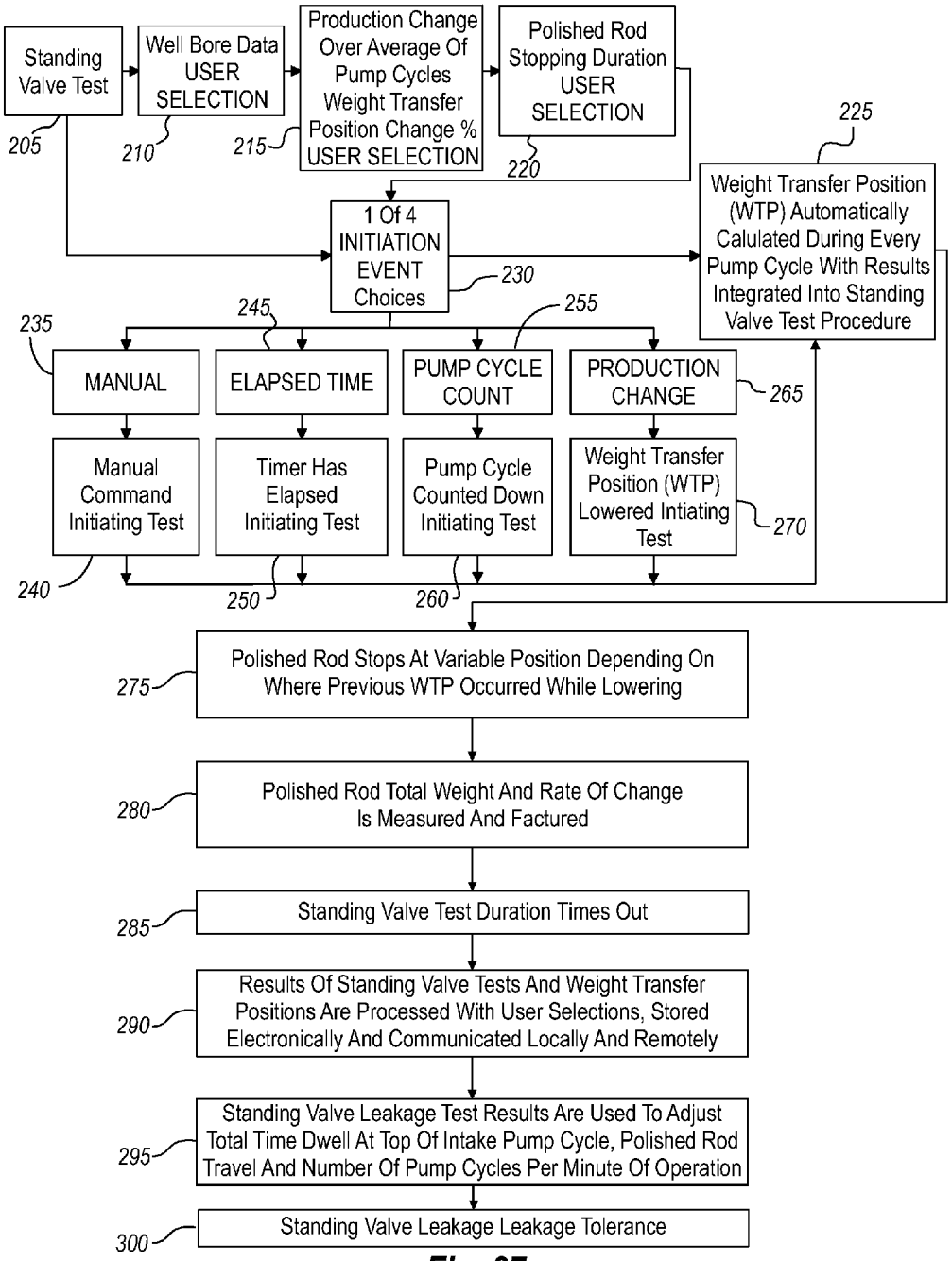
FIG. 27 Standing valve test method flow diagram

FIG. 27 illustrates the method process flow diagram for testing and detecting standing valve leakage autonomously by the surface unit, also called slippage factor of the standing valve 205. The flow chart illustrates using well bore diagram information 210, these are user inputs that include yet not limited to the ones listed herein for polished rod travel, pump setting depth, pump bore size, pump running clearance, pump stroke length, API pump style, fluid type, API grade (specific gravity) of fluid pumped, water cut percentage and whether it is a gas or oil well. The standing valve test process does not require this information but is helpful when detailing and illustrating the test results. The test results are a determination of the polished rod weight minimum and maximum plus rate of weight change over time allotted while the polished rod is held stationary by the surface unit after weight transfer has occurred down-hole. This combined value is the leakage factor also called slippage factor. Surface unit motion control of the polished rod dynamics utilizes this leakage factor for subsequent calculations in determining how best to power and control the down-hole pump to optimize production 300.

Weight transfer position falling percentage of total polished rod travel 215, is a user entered value which is the lowest weight transfer position the operating company wishes the surface unit to continue pumping at. This value is user selectable between 1-50% of total polished rod travel. Upon falling below this value for an average number of pump cycles also user selectable from 1-100 pump cycles; the surface unit shuts off and dispatches remote communication along with local display why the surface unit shut off.

Standing valve testing time duration 220 is user selectable entered in seconds from 1-100 seconds. It is the time the polished rod, during the lowering and after weight transfer has occurred pump cycle, is autonomously held stationary against gravity. Polished rod stopping position is dynamic every test. The stopping position is dependent upon where weight transfer took place on the previous pumping cycle. Once this position is determined 225 it is stored electronically and utilized when the standing valve test is initiated, plus utilized for optimizing the polished rod motion profile to raise weight transfer position PCO (further detailed in FIG. 28) on subsequent pump cycle or average of following pump cycles also user adjustable from 1-99 pump cycles.

Standing valve test 205 for certain preferred embodiments may be triggered off possible scenarios 230. They each are identified as 235, 245, 255, and 265. When triggered the standing valve test method is performed on the following pump cycle. Manual triggering 235; could be local at the well site 240 or remote off the well site triggered by remote communication protocols. Elapsed time triggering 245 in hours since previous test occurred 250. For certain preferred embodiments this time value may be user preselected and fully adjustable between 1-999 hours. Total number of pumping cycles having occurred 255 since previous test. Pumping cycle quantities 260 are user preselected and fully adjustable between 1-999,999 pump cycles.

Production change 265, represents a user preselected 270 and fully adjustable percentage value between 1-99% of detected falling weight transfer position. This value can be from the previous pump cycle or an average of previous pump cycles also user adjustable from 1-99 pump cycles. This falling weight transfer position percentage value would be greater than the value set in box 215. The falling weight transfer position is based from total polished rod travel as commanded and measured by the surface unit. The value is expressed in polished rod percentage of working barrel fillage of nearly non-compressible fluids. When this preset value has surpassed below the selected setting 270, it could indicate severe well damage and hence be an early warning indicator in preventing additional damages down-hole. Upon reaching this lowering weight transfer position 270 from previous pumping cycle or average of pumping cycles an alert communication is dispatched via external communication protocols as a warning to the supervisory position remotely off-site and displayed locally on the surface unit.

Upon initiation of testing process 205 as determined by process 230, the surface unit utilizes all user preselected test variables to perform standing valve test. After testing process has finished it resets the initiation process, resumes pumping and waits next triggering of 235, 245, 255 or 265. Upon next triggering the surface unit during the next lowering portion of the pump cycle and after weight transfer has occurred; proceeds to decelerate and stop the polished rod in a controlled manner 275, holding the polished rod stationary against gravity 220. Polished rod weight is measured initially upon stopping and continually monitored, factored and recorded 280 over stopping time duration 220. Upon time elapse 285 a maximum and minimum polished rod weight is known plus rate of increase over time is determined. This determined value is the leakage factor also called slippage factor of the standing valve assembly.

Standing valve slippage factor and WTP of previous pump cycle to this test cycle are output as a value and communicated locally plus transmitted via remote communication protocols 290. The surface unit runs until shut off either locally or remotely based upon a human decision to continue pumping or stop pumping based on standing valve leakage. Standing valve leakage value 300 is used to limit time dwell at the top of the pump intake cycle of the surface unit when engaged. This value 300 is used to limit minimum polished rod total travel of the surface unit when engaged. This value 300 is used to limit the minimum pump cycles per minute frequency of the surface unit when engaged.

Standing valve slippage factor represents a given volume of fluid that is leaking past the standing valve during normal pumping operation. This value of standing valve slippage could hinder daily production and increase cost of operating beyond an acceptable tolerance range of the operating company. Hence a user selectable and adjustable slippage factor tolerance between 1 and 1000 is used as indicated in box 305. 1 represents a very low leakage rate, 1000 represents a very large leakage rate. The tolerance value is devised from the well bore diagram information along with actual known down-hole operating conditions of the well and reservoir formation plus human intuition of expected production rates at time of initial commissioning. All user pre-selections are available for modifications any time with proper password identification entered locally or remotely.

When the standing valve leakage is excessive; time dwell at top of intake cycle, minimum polished rod travel distance and minimum pump cycles per minute all directly impact 300 daily production and daily cost of operating the specific well. By offering a slippage factor tolerance 305 pre-selectable between 1-1000 one is capable of tailoring the surface unit polished rod motion control to allow for differing well bore diagram operational installations and actual down-hole operating conditions The slippage tolerance value 1-1000; is the acceptable leakage value for the standing valve.

Figure 28:
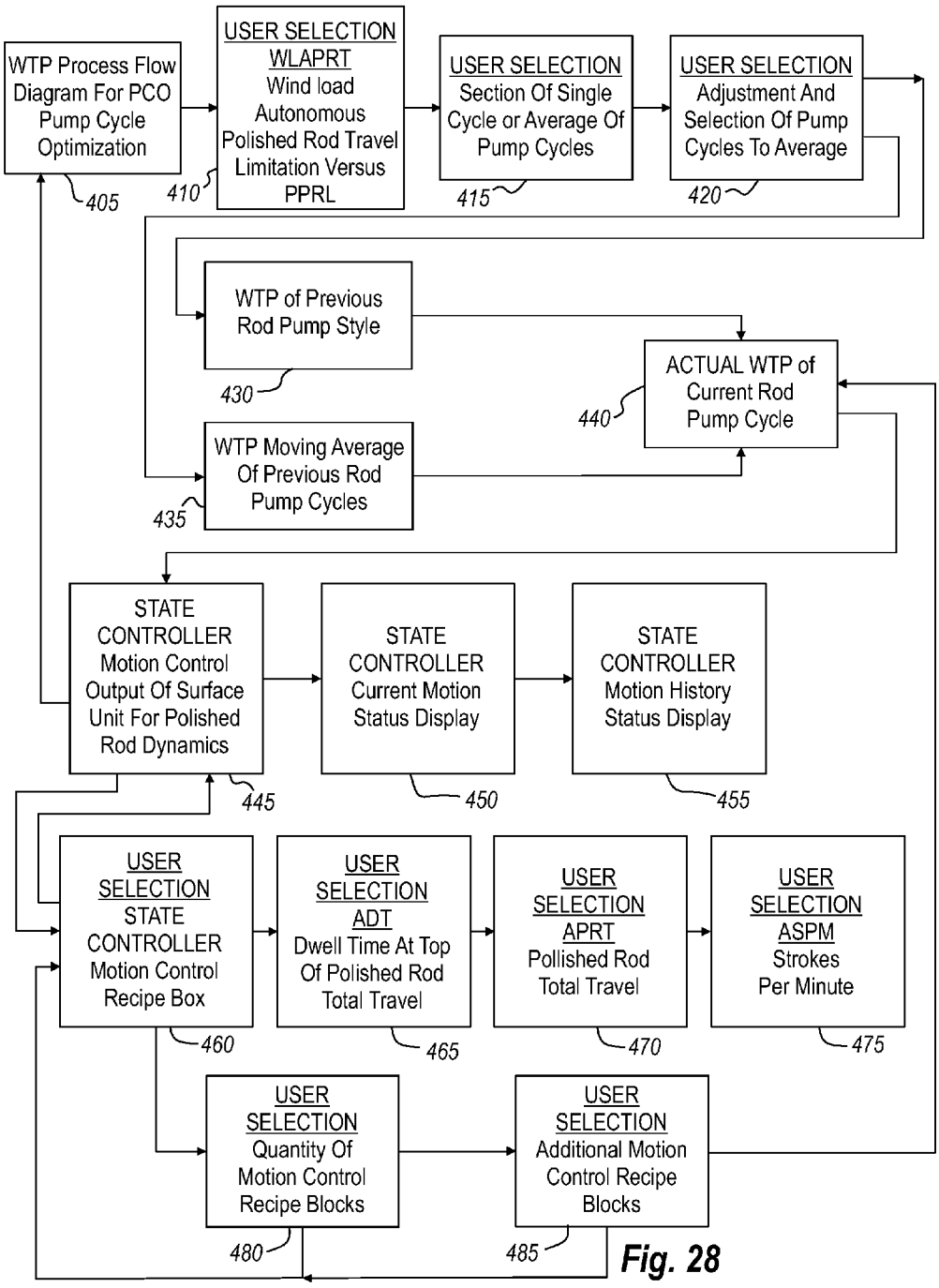
FIG. 28 Weight transfer position process flow diagram

FIG. 28 Weight transfer process flow diagram starting point 405 is based where weight transfer position has occurred on previous pump cycle or average of previous pump cycles. The first step in PCO, pump cycle optimization is monitoring wind speeds on each well location independently 410. An anemometer is installed on each surface unit to detect and monitor ever changing wind patterns. Each well location has different PPRL ratings for producing the well. User preselected individual values for total allowable PPRL and maximum wind speed while the surface unit lifts the polished rod to maximum travel distance. As the selected value of wind speed increases beyond the set point, polished rod total travel is reduced by a preselected travel distance value. Wind speed and polished rod total travel distance is set in a ratio and adjusted during initial commissioning of the surface unit. The values are governed by rod column guidelines of the surface unit as determined by the manufacturer of the specific size rating of the surface unit. WLAPRT 410 is designed to never operate the surface unit in an unsafe lifting condition of the polished rod in high wind conditions.

The operating company has a choice to monitor the previous pumping cycle 415 or average of previous pumping cycles 420. The number of pump cycles to average for determining weight transfer position trend is user adjustable from 1-99 pump cycles 415 and 420. The result of previous WTP 430 or running average 435 is an indicator of reservoir fluid inflow conditions to the annulus which directly affects the ability of the down-hole pump intake capacity of non-compressible fluids and daily production. During current pump cycle, WTP is determined 440, and compared to either 430 or 435 as previously selected.

State controller 445 governs the polished rod motion control output of the surface unit autonomously which in turn powers and controls the current pumping cycle implemented. Each current pump state controller output has a current status view locally or remotely 450. While the surface unit is operating the well any time upon acceptance of correct password the entire state history 455 is able to be viewed and transmitted electronically for review of well operating characteristics from past 30 days.

State controller 445 is made up of individual motion control recipe blocks 60. Within each motion control recipe block are the abilities to set parameters that add or subtract ADT 465, increase or decrease APRT 470, and setting over all pump cycles per minute ASPM 475.

Each motion control recipe block uses WTP 440 as the input command which activates the specific preset individual motion control recipe block. Each motion control recipe block 480 and all additional blocks 485 up to 410 total are typically divided in 10 percent intervals of total polished rod travel. As WTP 440 changes the so does the appropriate motion control recipe block 480 and 485 being the one that is currently commanding the surface unit polished rod motion control output. As WTP trends higher the motion control recipe block that corresponds to that specific WTP or average WTP value is the motion control block that controls the surface unit on the subsequent pump cycle or average of subsequent pump cycles.

TIME DWELL AS A POLISHED ROD MOTION CONTROL VARIABLE: If the WTP trend is downward time dwell 465 may be added at the top of polished rod travel allowing increased time duration for filling the working barrel down-hole. On the following pump cycle or average of pump cycles; weight transfer position is again monitored to detect a change higher or lower than previous. If the trend is higher time dwell 465 is reduced or removed, if the trend is lower additional time dwell is added. The process methodology is ongoing and designed to reach consistency in achieving the highest weight transfer position possible for the maximum number of pumping cycles.

POLISHED ROD TOTAL TRAVEL DISTANCE AS A MOTION CONTROL VARIABLE: If the WTP trend is downward reducing the maximum height the surface unit lifts the polished rod 470 will effectively reduce the down-hole pump displacement. As polished rod total lifting distance is reduced, the downward trending weight transfer position can be corrected for in reduced traveling valve motion within the working barrel. By achieving the highest possible weight transfer position versus polished rod travel percentage during the pump cycle fluid pound is minimized, and production is maximized. The process methodology of balancing total polished rod travel and highest weight transfer position within total polished rod travel percentage is ongoing and designed to reach consistency in achieving the highest weight transfer position possible for the maximum number of pumping cycles.

TOTAL STROKES PER MINUTE AS A MOTION CONTROL VARIABLE: If the WTP trend is downward slowing and reducing total number of pump cycles per minute 475 will effectively reduce the down-hole pump flow rate. As pump flow rate is reduced, the downward trending weight transfer position can be corrected for in reduced pump flow rate trying to leave the well installation, so reservoir formation fluid flow rate can be matched. As weight transfer position trends higher pump cycles per minute are increased to better match reservoir formation fluid inflows to the annulus. The process methodology of balancing total pump cycles per minute with highest weight transfer position is ongoing and designed to reach consistency in achieving the highest weight transfer position possible for the maximum number of pumping cycles.

It is not necessary to activate all 410 motion control recipe blocks 480 and 485. It is at the operating company's discretion and option to activate 1 thru 10 with varying weight transfer input activation levels.

Other embodiments and other variations and modifications of the embodiments described above will be obvious to a person skilled in the art. Therefore, the foregoing is intended to be merely illustrative of the invention and the invention is limited only by the following claims and the doctrine of equivalents.

What is claimed is:

1. Method for autonomous testing of traveling valve assembly leakage, traveling valve assembly leakage comprising a combination of traveling valve leakage and pump running clearance leakage between a plunger and a working barrel, for an oil or gas rod pumped well installation, the rod pumped well installation comprising a surface unit that is not mechanically counterbalanced, a production tubing string, a polished rod, a sucker rod string, and a down-hole pump assembly, the down-hole pump assembly including a traveling valve and a standing valve, the method comprising:

a) autonomous stopping and holding by the surface unit of the polished rod stationary against gravity during an upstroke of the polished rod and the sucker rod string, the polished rod being stopped based upon an occurrence of a traveling valve test initiation event, the polished rod being stopped at a polished rod traveling valve test position, and the polished rod being held for an upstroke stop duration, the traveling valve test initiation event, the polished rod traveling valve test position, and the upstroke stop duration being determined based upon one or more traveling valve test criteria selected by a user;

b) autonomous measurement of total polished rod load exerted by the polished rod, the sucker rod string, the traveling valve, and a fluid column in the production tubing string above the traveling valve and being supported by the traveling valve for a traveling valve test duration;

c) determination of a rate of change in the total polished rod load;

d) determination of a traveling valve leakage factor based upon the rate of change in the total polished rod load.

2. The method of claim 1 wherein the determination of the rate of change in the total polished rod load is autonomous.

3. The method of claim 1 wherein the determination of the traveling valve leakage factor based upon the rate of change in the total polished rod load is autonomous.

4. The method of claim 1, wherein the traveling valve test initiation event comprises the rod pumped well installation having completed a predetermined number of pump cycles.

5. The method of claim 1, wherein the traveling valve test initiation event comprises the elapse of a predetermined time period.

6. The method of claim 1, wherein the traveling valve test initiation event comprises a detection of a production rate change of a predetermined magnitude.

7. The method of claim 1, wherein the traveling valve test initiation event comprises a manually initiated traveling valve test.

8. The method of claim 1, further comprising storing the traveling valve leakage factor on an electronic storage medium.

9. The method of claim 1, further comprising transmitting the traveling valve leakage factor to a remote observation site.

10. The method of claim 1, further comprising transmitting the standing valve leakage factor to a remote observation site.

11. The method of claim 1, wherein the traveling valve test position is varied for successive traveling valve leakage tests.

12. Method for autonomous testing of standing valve leakage for an oil or gas rod pumped well installation, the rod pumped well installation comprising a surface unit that is not mechanically counterbalanced, a production tubing string, a polished rod, a sucker rod string, and a down-hole pump assembly, the down-hole pump assembly including a traveling valve and a standing valve, the method comprising:

a) autonomous stopping and holding by the surface unit of the polished rod stationary against gravity during a down stroke of the polished rod and sucker rod string, the polished rod being stopped at a polished rod standing valve test position after weight transfer to the production tubing string has occurred, the polished rod being stopped based upon an occurrence of a standing valve test initiation event, and the polished rod being held for a down stroke stop duration, the standing valve test initiation event, the polished rod standing valve test position, and the down stroke stop duration being determined based upon one or more standing valve test criteria selected by a user;

b) autonomous measurement of an initial total polished rod load exerted by the polished rod, the sucker rod string, and the traveling valve, without a fluid column load, weight transfer to the production tubing string having occurred and being supported by the standing valve;

c) autonomous measurement of the total polished rod load for a standing valve test duration, any polished rod load increases being due to standing valve leakage which results in traveling valve closure and the fluid column load being transferred back onto the polished rod and the sucker rod string and being supported by the traveling valve;

d) determination of a rate of change in the total polished rod load; and e) determination of a standing valve leakage factor based on the rate of change in the total polished road load.

13. The method of claim 12 wherein the determination of the rate of change in the total polished rod load is autonomous.

14. The method of claim 12 wherein the determination of the standing valve leakage factor based upon the rate of change in the total polished rod load is autonomous.

15. The method of claim 12, wherein the standing valve test initiation event comprises the rod pumped well installation having completed a predetermined number of pump cycles.

16. The method of claim 12, wherein the standing valve test initiation event comprises the elapse of a predetermined time period.

17. The method of claim 12, wherein the standing valve test initiation event comprises a detection of a production rate change of a predetermined magnitude.

18. The method of claim 12, wherein the standing valve test initiation event comprises a manually initiated standing valve test.

19. The method of claim 12, wherein the polished rod standing valve test position is varied based upon one or more weight transfer positions from prior pump cycles.

20. The method of claim 12, further comprising storing the standing valve leakage factor on an electronic storage medium.

21. The method of claim 12, wherein the standing valve test position is varied for successive standing valve leakage tests.

22. Method for autonomous adjustment of one or more pump operation characteristics, including one or more of dwell time, polished rod travel, and pump cycle rate, based upon an autonomously determined traveling valve leakage factor, for a rod pumped oil or gas well installation, the rod pumped well installation comprising a surface unit that is not mechanically counterbalanced, a production tubing string, a polished rod, a sucker rod string, and a down-hole pump assembly, the down-hole pump assembly including a traveling valve and a standing valve, the method comprising:

a) autonomous stopping and holding by the surface unit of the polished rod stationary against gravity during an upstroke of the polished rod and the sucker rod string, the polished rod being stopped based upon an occurrence of a traveling valve test initiation event, the polished rod being stopped at a polished rod traveling valve test position, and the polished rod being held for an upstroke stop duration, the traveling valve test initiation event, the polished rod traveling valve test position, and the upstroke stop duration being determined based upon one or more traveling valve test criteria selected by a user;

b) autonomous measurement of total polished rod load exerted by the polished rod, the sucker rod string, the traveling valve, and a fluid column in the production tubing string above the traveling valve and being supported by the traveling valve for a traveling valve test duration;

c) autonomous determination of a rate of change in the total polished rod load;

d) autonomous determination of the traveling valve leakage factor based upon the rate of change in the total polished rod load;

e) autonomous adjustment of one or more of the pump operation characteristics for successive pump cycles of the down-hole pump installation based upon the traveling valve leakage factor.

23. The method of claim 22, further comprising determining a weight transfer position from one or more weight transfer tests for one or more pump cycles of the down-hole pump and autonomously adjusting one or more of the pump operation characteristics for successive pump cycles of the down-hole pump installation based upon the weight transfer position.

24. The method of claim 23, further comprising autonomously determining respective successive weight transfer positions from a plurality of successive weight transfer tests for successive pump cycles of the down-hole pump, determining a weight transfer position variance from the respective successive weight transfer positions, and autonomously adjusting one or more of the pump operation characteristics for successive pump cycles of the down-hole pump installation based upon the weight transfer position variance.

25. The method of claim 22, wherein a detected weight transfer position variance from successive weight transfer position tests is used to adjust one or more of the pump operation characteristics.

26. The method of claim 22, wherein the traveling valve test initiation event comprises the rod pumped well installation having completed a predetermined number of pump cycles.

27. The method of claim 22, wherein the traveling valve test initiation event comprises the elapse of a predetermined time period.

28. The method of claim 22, wherein the traveling valve test initiation event comprises a detection of a production rate change of a predetermined magnitude.

29. The method of claim 22, wherein the traveling valve test initiation event comprises a manually initiated traveling valve test.

30. Method for autonomous adjustment of one or more pump operation characteristics, including one or more of dwell time, polished rod travel, and pump cycle rate, based upon an autonomously determined standing valve leakage factor for a rod pumped oil or gas well installation, the rod pumped well installation comprising a surface unit that is not mechanically counterbalanced, a production tubing string, a polished rod, a sucker rod string, and a down-hole pump assembly, the down-hole pump assembly including a traveling valve and a standing valve, the method comprising:

a) autonomous determination of a weight transfer position from one or more weight transfer tests for one or more pump cycles of the down-hole pump;

b) autonomous stopping and holding by the surface unit of the polished rod stationary against gravity during a down stroke of the polished rod and sucker rod string, the polished rod being stopped at a polished rod standing valve test position after weight transfer to the production tubing string has occurred, the polished rod being stopped based upon an occurrence of a standing valve test initiation event, and the polished rod being held for a down stroke stop duration, the standing valve test initiation event, the polished rod standing valve test position, and the down stroke stop duration being determined based upon one or more standing valve test criteria selected by a user;

c) autonomous measurement of an initial total polished rod load exerted by the polished rod, the sucker rod string, and the traveling valve, without a fluid column load, weight transfer to the production tubing string having occurred and being supported by the standing valve;

d) autonomous measurement of the total polished rod load for a standing valve test duration, any polished rod load increases being due to standing valve leakage which results in traveling valve closure and the fluid column load being transferred back onto the polished rod and the sucker rod string and being supported by the traveling valve;

e) autonomous determination of a rate of change in the total polished rod load;

f) autonomous determination of the standing valve leakage factor based on the rate of change in the total polished road load; and g) autonomous adjustment of one or more of the pump operation characteristics for successive pump cycles of the down-hole pump installation based upon the standing valve leakage factor.

31. The method of claim 30 further comprising autonomously adjusting one or more of the pump operation characteristics for successive pump cycles of the down-hole pump installation based upon the weight transfer position.

32. The method of claim 31, further comprising autonomously determining respective successive weight transfer positions from a plurality of successive weight transfer tests for successive pump cycles of the down-hole pump, determining a weight transfer position variance from the respective successive weight transfer positions, and autonomously adjusting one or more of the pump operation characteristics for successive pump cycles of the down-hole pump installation based upon the weight transfer position variance.

33. The method of claim 30, wherein a detected weight transfer position variance from successive weight transfer position tests is used to adjust one or more of the pump operation characteristics.

34. The method of claim 30, wherein the standing valve test initiation event comprises the rod pumped well installation having completed a predetermined number of pump cycles.

35. The method of claim 30, wherein the standing valve test initiation event comprises the elapse of a predetermined time period.

36. The method of claim 30, wherein the standing valve test initiation event comprises a detection of a production rate change of a predetermined magnitude.

37. The method of claim 30, wherein the standing valve test initiation event comprises a manually initiated standing valve test.

38. The method of claim 30, wherein the polished rod standing valve test position is varied based upon one or more weight transfer positions from prior pump cycles.

39. Method for autonomous adjustment of one or more pump operation characteristics, including one or more of dwell time, polished rod travel, and pump cycle rate, for a rod pumped oil or gas well installation, the rod pumped well installation comprising a surface unit that is not mechanically counterbalanced, a production tubing string, a polished rod, a sucker rod string, and a down-hole pump assembly, the down-hole pump assembly including a traveling valve and a standing valve, the method comprising:

a) autonomous determination of a weight transfer position from one or more weight transfer tests for one or more pump cycles of the down-hole pump; and b) autonomous adjustment of one or more of the pump operation characteristics for successive pump cycles of the down-hole pump installation based upon the weight transfer position.

40. The method of claim 39, further comprising autonomously determining respective successive weight transfer positions from a plurality of successive weight transfer tests for successive pump cycles of the down-hole pump, determining a weight transfer position variance from the respective successive weight transfer positions, and autonomously adjusting one or more of the pump operation characteristics for successive pump cycles of the down-hole pump installation based upon the weight transfer position variance.

41. Method for autonomous adjustment of one or more pump operation characteristics, including one or more of dwell time, polished rod travel, and pump cycle rate, based upon an autonomously determined traveling valve leakage factor and an autonomously determined standing valve leakage factor for a rod pumped oil or gas well installation, the rod pumped well installation comprising a surface unit that is not mechanically counterbalanced, a production tubing string, a polished rod, a sucker rod string, and a down-hole pump assembly, the down-hole pump assembly including a traveling valve and a standing valve, the method comprising:

a) autonomous stopping and holding by the surface unit of the polished rod stationary against gravity during an upstroke of the polished rod and the sucker rod string, the polished rod being stopped based upon an occurrence of a traveling valve test initiation event, the polished rod being stopped at a polished rod traveling valve test position, and the polished rod being held for an upstroke stop duration, the traveling valve test initiation event, the polished rod traveling valve test position, and the upstroke stop duration being determined based upon one or more traveling valve test criteria selected by a user;

b) autonomous measurement of total polished rod load exerted by the polished rod, the sucker rod string, the traveling valve, and a fluid column in the production tubing string above the traveling valve and being supported by the traveling valve for a traveling valve test duration;

c) autonomous determination of a rate of change in the total polished rod load for the traveling valve test;

d) autonomous determination of the traveling valve leakage factor based upon the rate of change in the total polished rod load for the traveling valve test;

e) autonomous determination of a weight transfer position from one or more weight transfer tests for one or more pump cycles of the down-hole pump;

f) autonomous stopping and holding by the surface unit of the polished rod stationary against gravity during a down stroke of the polished rod and sucker rod string, the polished rod being stopped at a polished rod standing valve test position after weight transfer to the production tubing string has occurred, the polished rod being stopped based upon an occurrence of a standing valve test initiation event, and the polished rod being held for a down stroke stop duration, the standing valve test initiation event, the polished rod standing valve test position, and the down stroke stop duration being determined based upon one or more standing valve test criteria selected by a user;

g) autonomous measurement of an initial total polished rod load exerted by the polished rod, the sucker rod string, and the traveling valve, without a fluid column load, weight transfer to the production tubing string having occurred and being supported by the standing valve;

h) autonomous measurement of the total polished rod load for a standing valve test duration, any polished rod load increases being due to standing valve leakage which results in traveling valve closure and the fluid column load being transferred back onto the polished rod and the sucker rod string and being supported by the traveling valve;

i) autonomous determination of a rate of change in the total polished rod load for the standing valve test;

j) autonomous determination of the standing valve leakage factor based on the rate of change in the total polished road load; and k) autonomous adjustment of one or more of the pump operation characteristics for successive pump cycles of the down-hole pump installation based upon the traveling valve leakage factor and the standing valve leakage factor.

42. The method of claim 41, further comprising autonomously adjusting one or more of the pump operation characteristics for successive pump cycles of the down-hole pump installation based upon the weight transfer position.

43. The method of claim 42, further comprising autonomously determining respective successive weight transfer positions from a plurality of successive weight transfer tests for successive pump cycles of the down-hole pump, determining a weight transfer position variance from the respective successive weight transfer positions, and autonomously adjusting one or more of the pump operation characteristics for successive pump cycles of the down-hole pump installation based upon the traveling valve leakage factor, the standing valve leakage factor, and the weight transfer position variance.

44. The method of claim 41, wherein the traveling valve test initiation event comprises the rod pumped well installation having completed a predetermined number of pump cycles.

45. The method of claim 41, wherein the traveling valve test initiation event comprises the elapse of a predetermined time period.

46. The method of claim 41, wherein the traveling valve test initiation event comprises a detection of a production rate change of a predetermined magnitude.

47. The method of claim 41, wherein the traveling valve test initiation event comprises a manually initiated traveling valve test.

48. The method of claim 41, wherein the standing valve test initiation event comprises the rod pumped well installation having completed a predetermined number of pump cycles.

49. The method of claim 41, wherein the standing valve test initiation event comprises the elapse of a predetermined time period.

50. The method of claim 41, wherein the standing valve test initiation event comprises a detection of a production rate change of a predetermined magnitude.

51. The method of claim 41, wherein the standing valve test initiation event comprises a manually initiated standing valve test.

52. The method of claim 41, wherein the polished rod standing valve test position is varied based upon one or more weight transfer positions from prior pump cycles.

* * * * *